US012698699B2

(12) United States Patent
Pearce et al.

(10) Patent No.: US 12,698,699 B2
(45) Date of Patent: Aug. 4, 2026

(54) SYSTEM AND METHOD OF REDUCING EMISSIONS AND INCREASING SWELL IN AN OIL CONDITIONING PROCESS

(71) Applicant: Maze Environmental LLC, Cypress Mill, TX (US)

(72) Inventors: Brooks Pearce, Cypress Mill, TX (US); Christopher Ray Ezell, Paradise, TX (US)

(73) Assignee: Maze IP, LLC, Cypress Mill, TX (US)

( * ) Notice: Subject to any disclaimer, the term of this patent is extended or adjusted under 35 U.S.C. 154(b) by 95 days.

(21) Appl. No.: 18/515,950

(22) PCT Filed: May 24, 2022

(86) PCT No.: PCT/US2022/030774
§ 371 (c)(1),
(2) Date: Nov. 21, 2023

(87) PCT Pub. No.: WO2022/251255
PCT Pub. Date: Dec. 1, 2022

(65) Prior Publication Data

US 2025/0137367 A1 May 1, 2025

Related U.S. Application Data

(63) Continuation-in-part of application No. 17/488,819, filed on Sep. 29, 2021, now Pat. No. 11,725,152.

(60) Provisional application No. 63/196,154, filed on Jun. 2, 2021, provisional application No. 63/192,454, filed on May 24, 2021.

(51) Int. Cl.
*B01D 53/22* (2006.01)
*C10G 7/02* (2006.01)
*E21B 43/34* (2006.01)

(52) U.S. Cl.
CPC ..... *E21B 43/34* (2013.01); *C10G 7/02* (2013.01)

(58) Field of Classification Search
CPC ..... E21B 43/34; C10G 7/02
See application file for complete search history.

(56) References Cited

U.S. PATENT DOCUMENTS

2013/0026082 A1* 1/2013 Al-Shafei ..... C10G 31/08 210/96.1
2014/0142204 A1* 5/2014 Kibby ..... C10G 45/58 208/100
2015/0021235 A1* 1/2015 Eriksen ..... E21B 43/36 208/187
2015/0267129 A1* 9/2015 Meyer ..... C10G 53/02 431/202
2017/0204337 A1* 7/2017 Mehra ..... C10G 7/02
2020/0165528 A1* 5/2020 Nanda ..... C10G 7/00
2021/0115775 A1* 4/2021 Hotton ..... B01D 17/0208
(Continued)

*Primary Examiner* — Anthony Shumate
(74) *Attorney, Agent, or Firm* — Harper & Bates LLP; Shannon W. Bates

(57) ABSTRACT

A system for conditioning live crude oil to produce stabilized oil that can be stored in a conventional oil storage tank and hydrocarbon gas includes a stabilizer tower and a heater treater. The stabilizer tower receives oil from separators at the wellhead production facility and outputs oil to the heater treater. The heater treater outputs gas back into the stabilizer tower and, optionally, recycles a portion of oil output back into the heater treater, which enhances oil output.

24 Claims, 23 Drawing Sheets

(56) References Cited

U.S. PATENT DOCUMENTS

| | | | | |
|---|---|---|---|---|
| 2022/0081622 | A1* | 3/2022 | Gajbhiye | G09B 25/02 |
| 2022/0325188 | A1* | 10/2022 | Nanda | B01D 3/06 |
| 2022/0380684 | A1* | 12/2022 | Soliman | B01D 17/06 |
| 2023/0250346 | A1* | 8/2023 | Soliman | B01D 17/04 208/187 |
| 2024/0093108 | A1* | 3/2024 | Karode | B01D 53/268 |

* cited by examiner

SYSTEM AND METHOD OF REDUCING EMISSIONS AND INCREASING SWELL IN AN OIL CONDITIONING PROCESS

CROSS-REFERENCE TO RELATED APPLICATIONS

This application is a national stage application, filed under 35 U.S.C. § 371, of PCT International Patent Application No. PCT/US2022/030774 entitled "System and Method of Reducing Emissions and Increasing Swell in an Oil Conditioning Process" and filed on May 24, 2022, which claims the benefit of priority to: U.S. patent application Ser. No. 17/488,819 entitled "System and Method of Reducing Emissions and Increasing Swell in an Oil Conditioning Process" and filed on Sep. 29, 2021, U.S. Provisional Patent Application Ser. No. 63/196,154 entitled "System and Method of Reducing Emissions and Increasing Swell in an Oil Conditioning Process" and filed on Jun. 2, 2021, and U.S. Provisional Patent Application Ser. No. 63/192,454 entitled "Crude Oil Stabilizer" and filed on May 24, 2021, all of which are incorporated herein by reference.

BACKGROUND

The present invention relates to oil and gas production, and more particularly to technology for conditioning or stabilization of live crude oils at the outlet of the extraction well.

The output of oil and gas well-heads typically includes oil, water, and gas, often in an emulsion, at pressures between approximately 150 PSI and 1,500 PSI (10 and 100 bars). The process partial distillation of live crude oil and reducing the well-head pressure according to API standards is referred to as stabilization.

In a typical stabilization process, illustrated in FIG. 1A, a live crude oil stream 1320 (including oil, gas, and water) from a wellhead 1220 first goes to a separator 1230. The separator 1230 reduces the pressure of the live crude oil stream 1320 and outputs an oil stream 1332, a gas stream 1334, and a water stream 1336. Among the output streams from the separator 1230, gas 1334 released from emulsion can go directly to sale, water 1336 removed from the bottom can go to a storage and/or treatment facility, and oil stream 1332 can go to a tank 1235 for holding for additional stabilization, as oil stream 1332 typically contains light hydrocarbons and water and is at higher than atmospheric pressure, after processing only by the separator 1230.

In many conventional systems (FIG. 1A), oil stream 1332 is pumped from the tank 1235 into a heater treater 1240, which typically outputs an oil stream 1342, a gas stream 1334, and a water stream (not shown in FIG. 1A). Gas stream 1334 can go to a vapor recovery compressor 1260 or like device, as gas is moved for sale. Oil stream 1342 can go to a stabilizer tower 1250, which can output a gas stream 1354 and an oil stream 1352. Gas stream 1354 can go to a vapor recovery compressor 1260 or like device, as gas stream 1354 is moved for sale. Oil stream 1352 is stabilized to the degree that it can be stored in a conventional stabilized crude oil tank 1265 at or near atmospheric pressure. Each of the prior art components are explained below.

In general, a separator is a pressure vessel that, in a two-phase unit, receives a process flow for a retention time that allows lighter hydrocarbons to escape from the flow stream as a gas. In a three-phase separator, water also settles out from the oil for removal beneath the oil outlet of the separator. A separator generally includes internal portions or devices to promote separation, sometimes referred to as gravity settling, of the oil and water and release the gas. Often a mist extractor is used to remove liquid droplets from the gas. A separator often includes a liquid-level controller and a means to control internal pressure.

Often several stages of separation are employed, depending on the particular process variables of the site, to reduce pressure in stages. The separator is sometimes referred to as a Trap, a Knockout vessel, a flash chamber, an expansion vessel, or the like. Typically, the separator 1230 is near wellhead 1220, although in some installations may be located a mile away. Many separator designs have been developed, and the explanation of separator in general and/or separator 1230 is not intended to be limiting in any way.

In general, a heater treater, such as heater treater 1240, is a 3-phase vessel that utilizes heat and mechanical separation devices for further separating the oil stream 1332 from the separator 1230 into an oil stream 1342, a gas stream 1334, and a water stream (not shown in FIG. 1A). Heater treaters typically include a degassing section, a heating section, differential oil control, and a coalescing section, although not every section is required to meet the definition of a heater treater.

Oil stream 1332 (or untreated, live oil in installations that do not have an initial separator, such as separator 1230) enters the degassing section via an inlet—often at the top of the vessel. Gases that are easily released are vented into a gas collection line that often includes a mist extractor, to produce gas stream. Water within the oil stream 1332 can drop to the bottom of the vessel for removal at a water outlet. After initial degassing, the emulsion passes into a heating section, which often includes a tube-type heat exchanger to approximately 100 to 160 degrees F. Some heater treaters have a section containing a filtering medium to screen solid particles out of the oil. This process of heating the crude at this stage decreases the oil viscosity and promotes separation of the oil and water.

In some embodiments, a heater treater includes a coalescing section that can include a spreader and an electrostatic device that passes alternating current through the emulsion to promote formation of water droplets, which promotes separation of the water droplets by gravity. The remaining "dry" oil can be removed from the heater treater by an oil outlet at an appropriate location on the heater treater unit.

Many heater treater designs have been developed, including vertical and horizontal configurations, the choice of which depends on the particular desired parameters, such as design throughput, cycle time, and like factors.

Upon exiting the heater treater 1240, the oil stream 1342 can go to a stabilizer tower 1250. In general, a stabilizer tower, such as stabilizer tower 1250, typically includes trays, structured packing, and/or random packing in a column to promote contact between the vapor and liquid phases, permitting the transfer of mass and heat from one phase to the other. The trays have orifices for dispersing the gas uniformly on the tray and through the liquid on the tray. Types of trays include valve, bubble cap, and perforated-types. Structured packing often are perforated plates that are folded and/or welded together. Random packing is available in many sizes, geometric shapes.

Partial fractionation or distillation of the oil often occurs in the stabilizer tower. The heavier components and higher hydrocarbons flow through the column as liquid. Some of the liquid from the bottom of the column is withdrawn and circulated through reboiler in some configurations to add heat to the process. In the reboiler, the lighter components are driven off as a gas. At each tray or stage the rising gas performs a stripping operation such that the lighter components in the gas increase as the gas rises through the column. Pressure inside the stabilizer column can range typically between 50 to 200 PSIG (3.4 to 14 bars). Other configurations, such as a reflux system, additional heat exchangers, and like equipment and processing may be included.

The stabilized oil stream 1352, often comprising pentane and higher hydrocarbons (C5+), exits the base of stabilizer tower 1250. Oil stream 1352 may then be stored in tank 1265 at or near atmospheric pressure for eventual transport to an oil refinery or like user.

The term "swell" is often used to refer to the increase in volume of an in-ground reservoir fluid (that is, in-ground), which includes oil, when solvent molecules dissolve in the reservoir fluid. In this regard, reservoir oil swell can enhance recovery of oil trapped in inaccessible pore spaces. This specification used the term "swell," also referred to as "uplift," to refer to the volumetric expansion of an oil stream flow rate during processing.

SUMMARY

A system and method for conditioning live crude oil in some embodiments increases volumetric oil output and decreases fugitive emissions relative to prior art systems. A system for conditioning live crude oil can include a separator, a stabilizer tower, and a heater treater that includes feeding a heater treater output gas to the stabilizer tower.

The separator is adapted for receiving live crude oil from a wellhead and for producing a separator oil output and a separator gas output. The separator in some cases is considered part of the wellhead production facility. The stabilizer tower is adapted for (i) receiving the separator oil output and receiving a heater treater gas output and (ii) producing a stabilizer tower oil output and a stabilizer tower gas output.

The heater treater is adapted for (i) receiving the stabilizer tower oil output and (ii) producing a heater treater oil output and the heater treater gas output; wherein the heater treater gas output has a temperature that is higher than the stabilizer tower gas output and the heater treater oil output is stabilized oil. A portion of the heater treater oil output may be recycled to a heater treater inlet.

The system for conditioning live crude oil can include a vapor recovery unit (VRU) adapted for (i) receiving the stabilizer tower gas output and (ii) producing a VRU gas output and a VRU oil output, the heater treater being adapted for receiving the VRU oil output. The VRU can include discrete components and/or a packaged compressor and accessory components, while still being a VRU as used herein.

The heater treater may be adapted for recirculating a recirculating portion of the heater treater oil output into the heater treater. And the recirculating portion of the heater treater oil output may be combined with the VRU oil output upon or before entering the heater treater. The system may yield an oil volumetric production rate output (that is, stabilized oil that may be measured at a stabilized oil tank) that is greater than a volumetric production rate of the oil component of the live crude oil from the wellhead, wherein the volumetric production rates are measured in BOPD.

The live crude oil fed to the conditioning system includes at least an oil component and a gas component, and typically also includes a water component. Thus, the components disclosed herein may be two phase or three phase components. Typically, some aspect of the system will include a water separation capability.

Hydrocarbon gas from the separator and/or from the stabilizer may be sent to at least one of a user, the stabilizer tower, and the heater treater. The stabilizer components may be pre-assembled (that is, in a fabrication facility) and mounted on a skid (that is, a unitary structural steel frame). The heater treater components may also be pre-assembled and mounted on a skid.

The process for conditioning oil, often including increasing swell or uplift, can include steps for operating the system as described (in whole or in part) herein, including providing gas from the heater treater directly to the separator. The process for conditioning live crude oil may include the steps of: receiving a live crude oil stream from a wellhead into a separator, the live crude oil stream including at least an oil component and a gas component; separating a first gas stream from the live crude oil in the separator to create at least a first oil stream; receiving the first oil stream from the separator into a stabilizer tower; separating a second gas stream from the first oil stream in the stabilizer tower to create a second oil stream; receiving the second oil stream into a heater treater; separating a third gas stream from the second oil stream in the heater treater to create a stabilized oil stream and a third oil stream, and circulating the third gas stream from the heater treater to the stabilizer wherein the third gas stream combines with the second gas stream to create a combined second gas stream, the combined second gas stream flowing to a vapor recovery compressor; moving the stabilized oil stream to a stabilized oil tank; and circulating the third oil stream within the heater treater. The stabilized oil stream has a greater volumetric flow rate, measured in BBLD, than the volumetric flow rate of the oil component of the live oil stream, measured in BBLD.

The process may include the step of circulating a recirculating portion of the second gas stream from the stabilizer tower to the heater treater and a conditioned portion of the second gas stream from the stabilizer tower to a user, and may include a step of circulating a recirculating portion of the second gas stream from the stabilizer tower to the heater treater and a conditioned portion of the second gas stream from the stabilizer tower to a user.

The process may include the step of flowing the stabilized oil stream to a stabilized crude oil tank that is approximately at atmospheric pressure. The step of circulating the third oil stream includes inputting the third oil stream at an inlet of the heater treater.

The word stream does not require that the process be perfectly continuous or steady state. For merely one example, dump valves may operate in the equipment such that they close temporarily in response to liquid level in a unit.

Produced oil stream 1456 will then flow into the oil storage tank 1646. Gas stream 1458 produced from the vapor recovery tower 1746 will typically be comingled with the produced gas 1334 from heater treater 1346 and will be sent to the vapor recovery compressor 1430. The vapor recovery compressor 1430 will typically control the pressure of the vapor recovery tower. The produced gas 1334 from heater treater 1346 can sometimes go straight to sales gas instead of to vapor recovery compressor 1430. Vapor recovery compressor 1430 will compress the inlet gas and add line pressure so that it may be comingled with the higher pressure gas produced from 3-phase separator 1230 and be sent to gas sales.

Figure 1A:
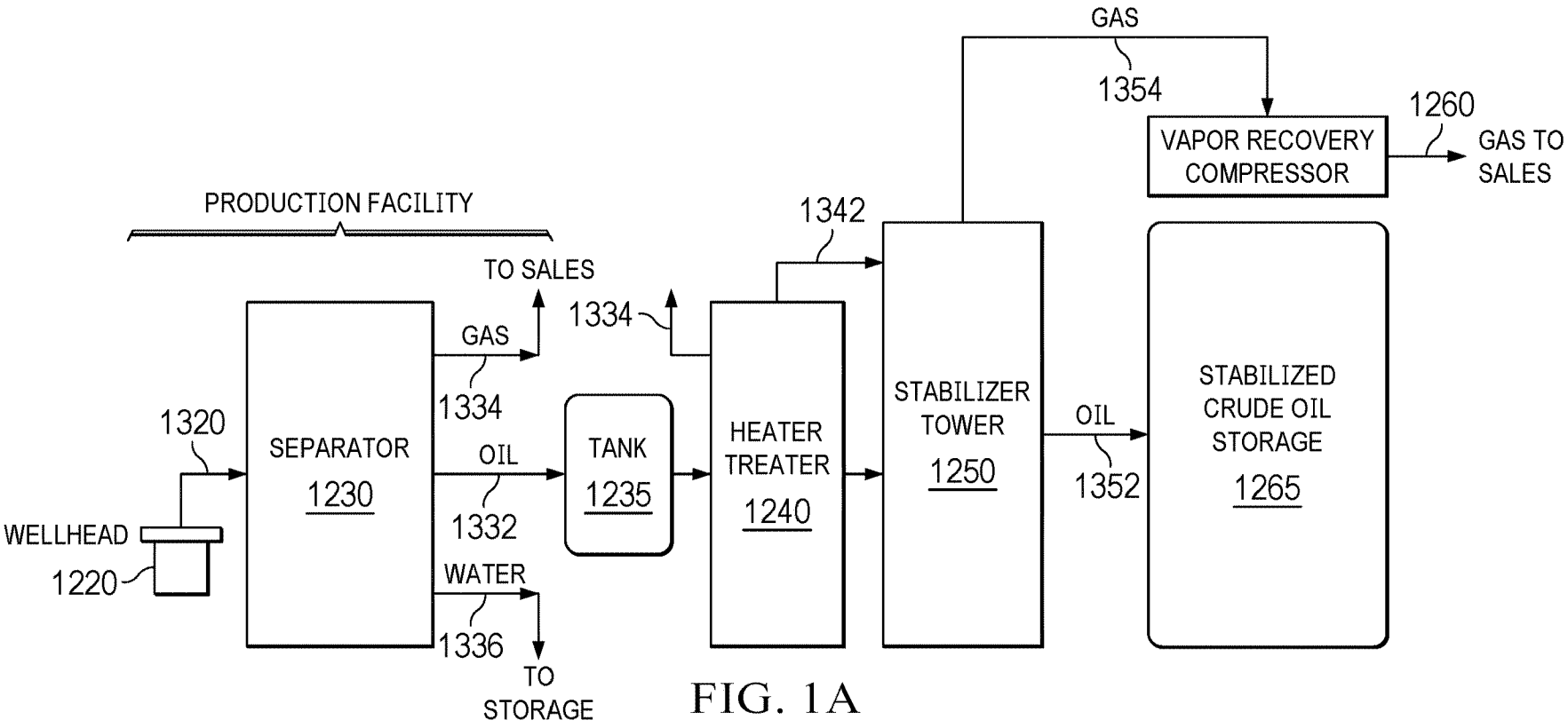
FIG. 1A (PRIOR ART)
FIG. 1A (Prior Art) is a process flow diagram of a conventional live crude oil stabilization process.
Figure 1B:
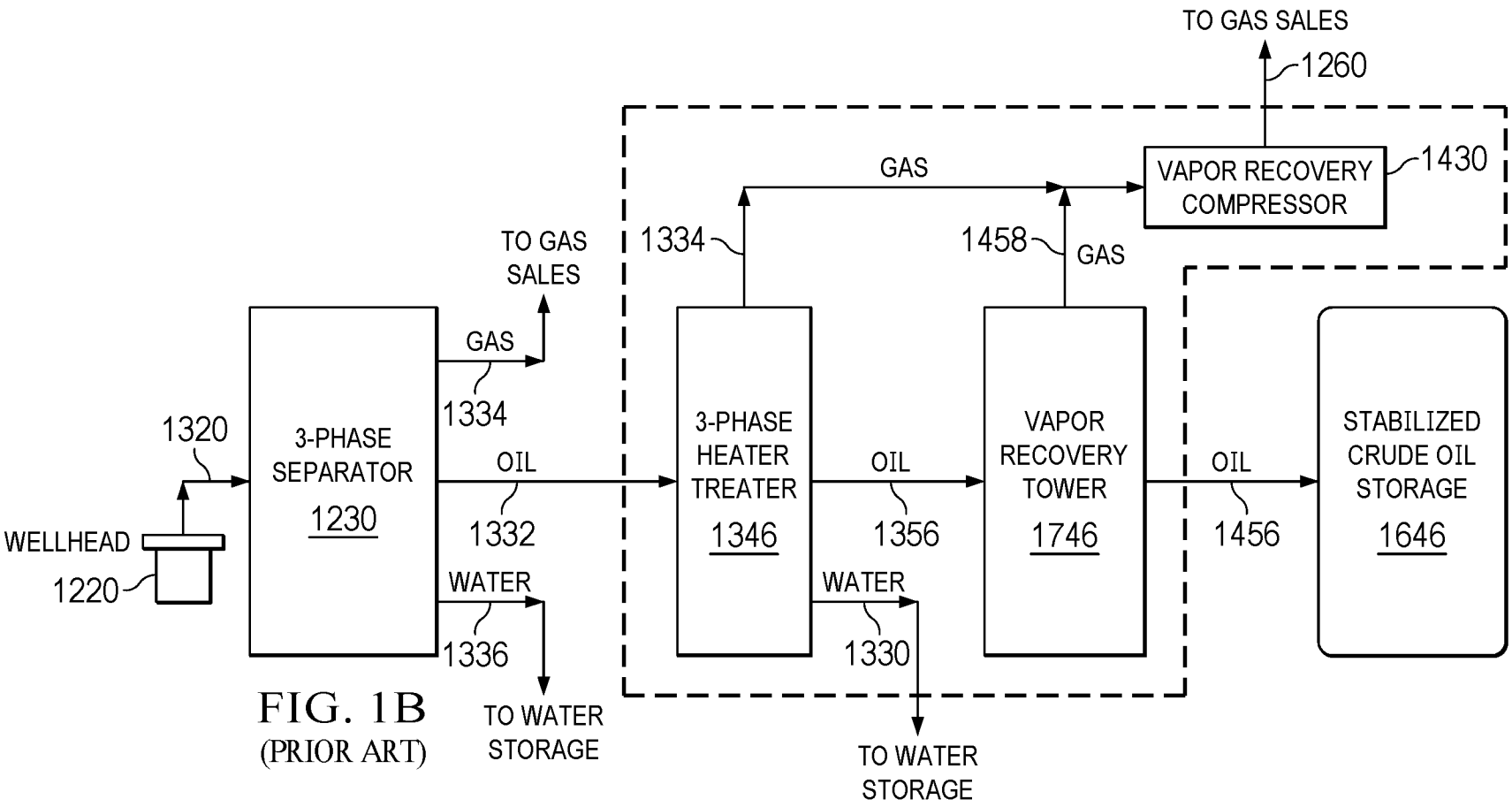
FIG. 1B (PRIOR ART)
FIG. 1B (Prior Art) shows a simple diagram of a traditional production facility using a vapor recovery tower to capture emissions off produced oil. This process describes a traditional upstream production facility process to eliminate emissions. From the wellhead, crude oil stream 1320 flows into a 3-phase separator 1230. Oil produced flows into a 3-phase heater treater 1346. Using applied heat and retention time, the inlet fluids to the heater treater will produce oil stream 1356, water stream 1330, and a gas stream 1334. Oil stream 1356 flows into a vapor recovery tower 1746. A vapor recovery tower is typically a 2-phase vertical tower, separating gas from oil. A vapor recovery tower can sometimes produce water. By operating the vapor recovery tower at a lower pressure than the upstream heater treater, this allows gas to separate from the inlet oil fluid. A vapor recovery tower is typically an open vessel with an internal pipe upcomer to drain oil from the bottom of the vessel into an oil storage tank. Sometimes there is a mesh pad in the tower.
Figure 1C:
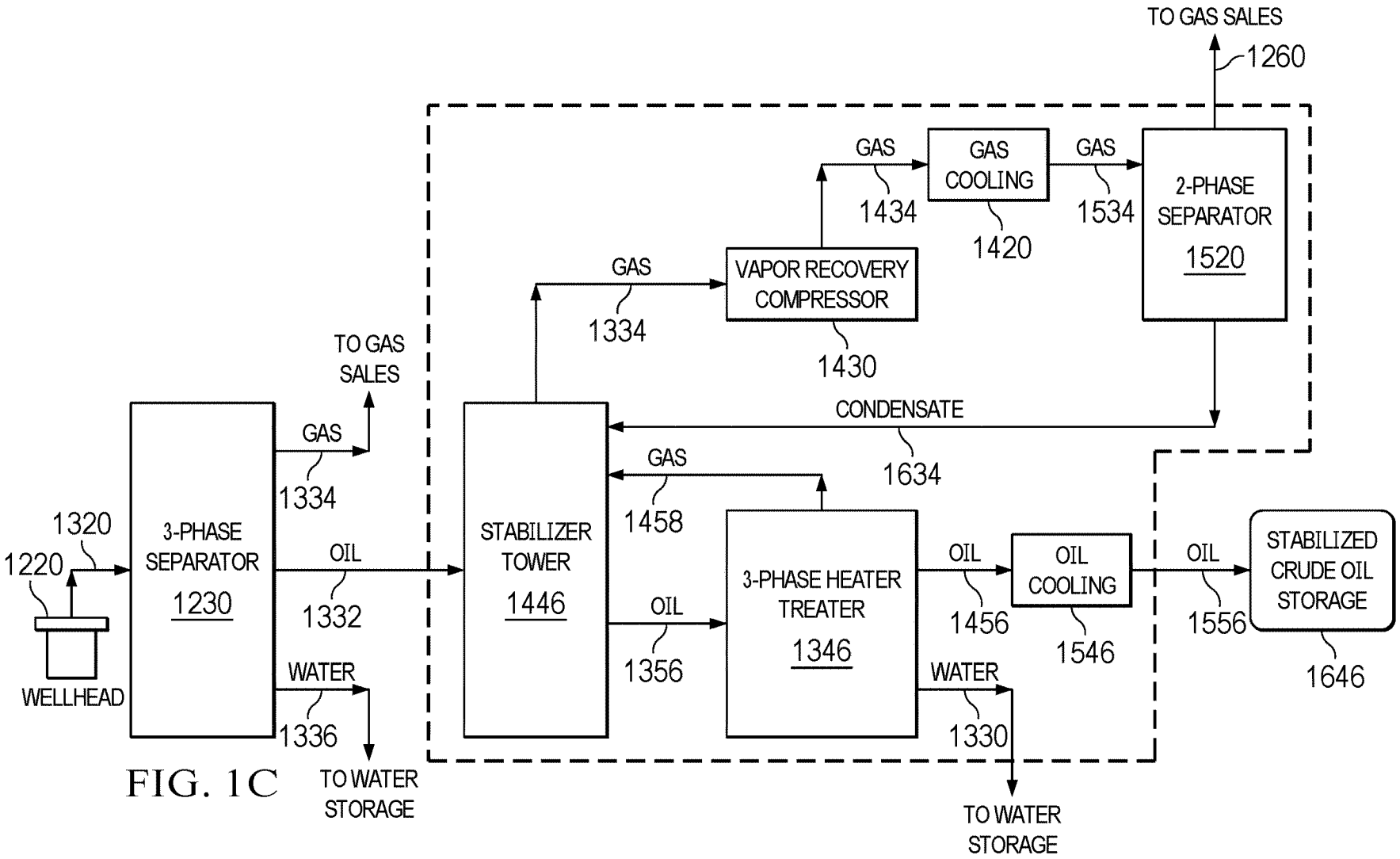

FIG. 1C shows a simple diagram of a production facility using an oil stabilization tower to capture emissions of produced oil. This figure is similar to FIG. 1B except it uses a stabilizer tower 1446 to release gas from produced oil stream 1332 by operating at low pressure.

Figure 1D:
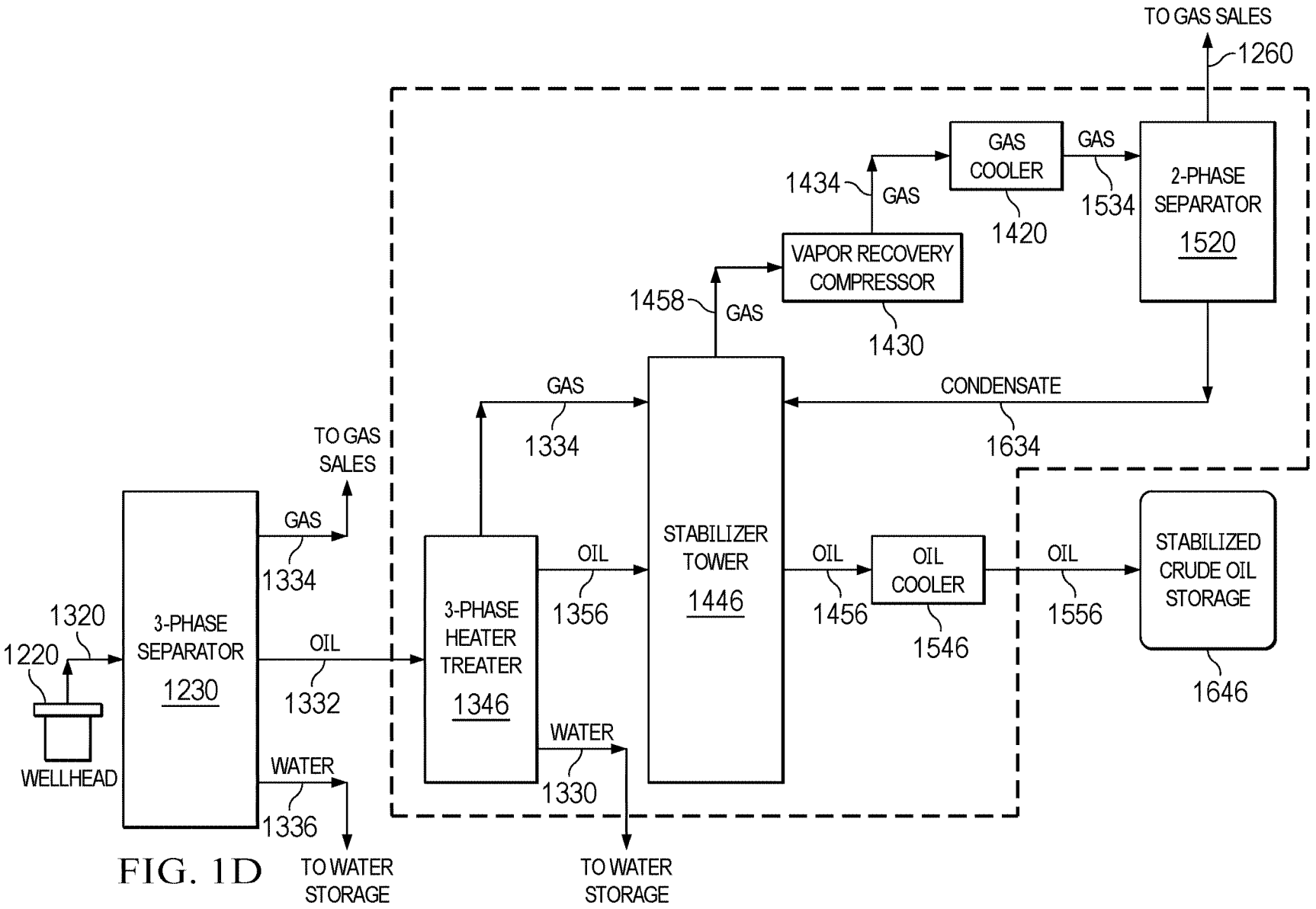

FIG. 1D shows a simple diagram of a production facility using an oil stabilization tower to capture emissions of produced oil. This figure is similar to FIG. 1C except the stabilizer tower 1446 is downstream of the heater treater 1346 and the pressure is not equalized between the two vessels. Produced oil from 3-phase separator 1230 sends oil to heater treater in stream 1332. Heater treater will operate at a pressure to send the produced oil stream 1356 to the stabilizer tower. Produced gas from the heater treater 1346 will flow to the bottom of the stabilizer tower similar to FIG. 1C. Produced oil 1456 from stabilizer tower 1446 will flow directly to oil cooling. Gas stream 1534 from the vapor recovery compressor is sent to a gas cooling process to extract liquids of the gas stream.

Figure 1E:
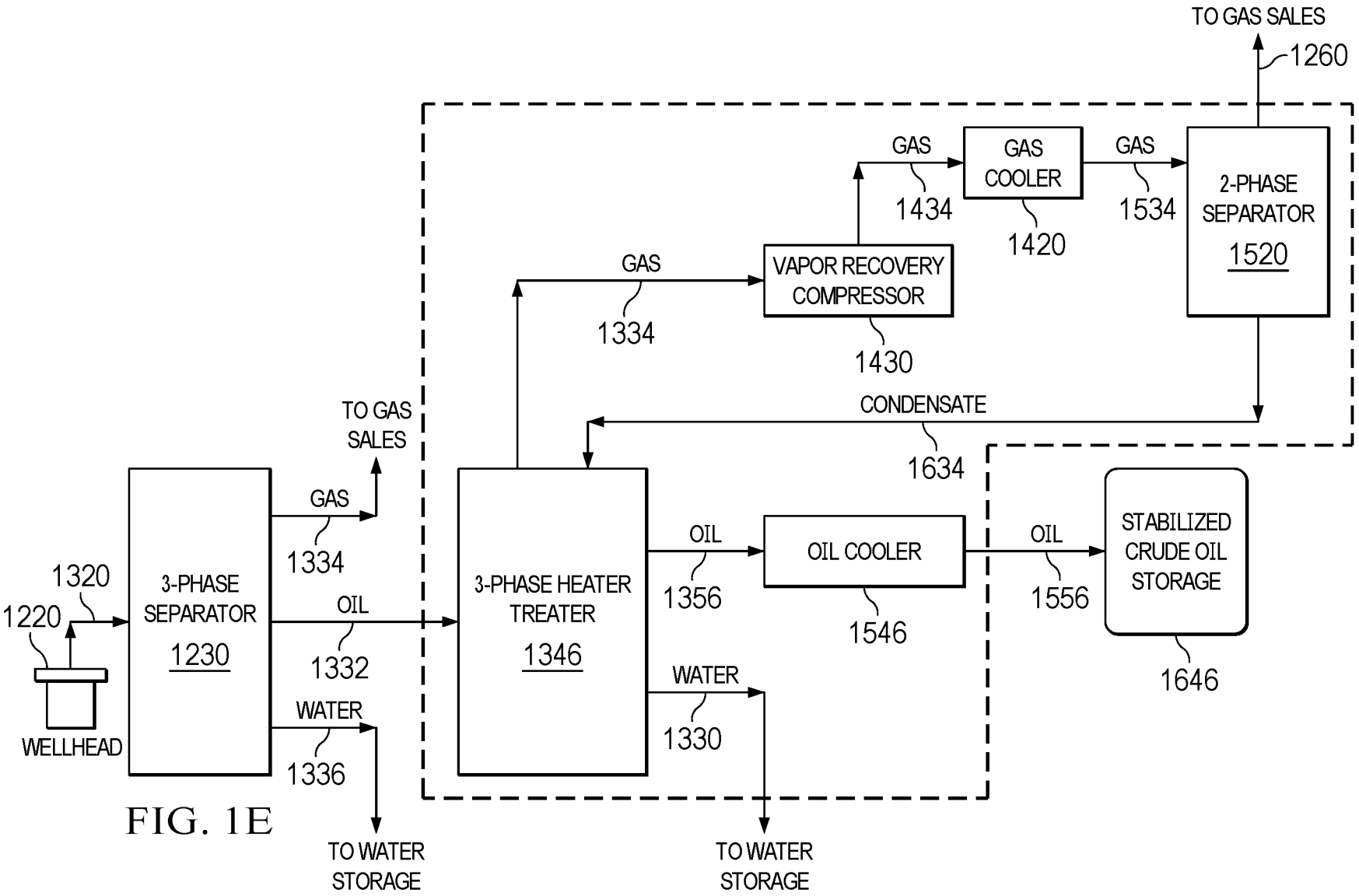

FIG. 1E shows a simple diagram of a production facility using a heater treater to capture emissions of produced oil. This figure is similar to FIG. 1D except the heater treater 1346 will act at the low pressure vessel and a stabilizer tower is not needed. Heater treater 1346 will operate at low pressure and will allow gas to separate from the oil. Produced gas in stream 1334 will go through the same liquid recovery process, compressing and cooling the gas to collect condensate. Condensate 1634 will be sent from 2-phase separator 1520 back to the heater treater. The condensate will vaporize and mix with the low pressure vapor space inside heater treater 1346 and cause heavy hydrocarbons the fall out of the gas and add swell and an uplift in oil production. Produced oil stream 1356 from heater treater 1346 will be sent to oil cooling to stabilize the oil stream before entering oil storage tank 1646.

Figure 1F:
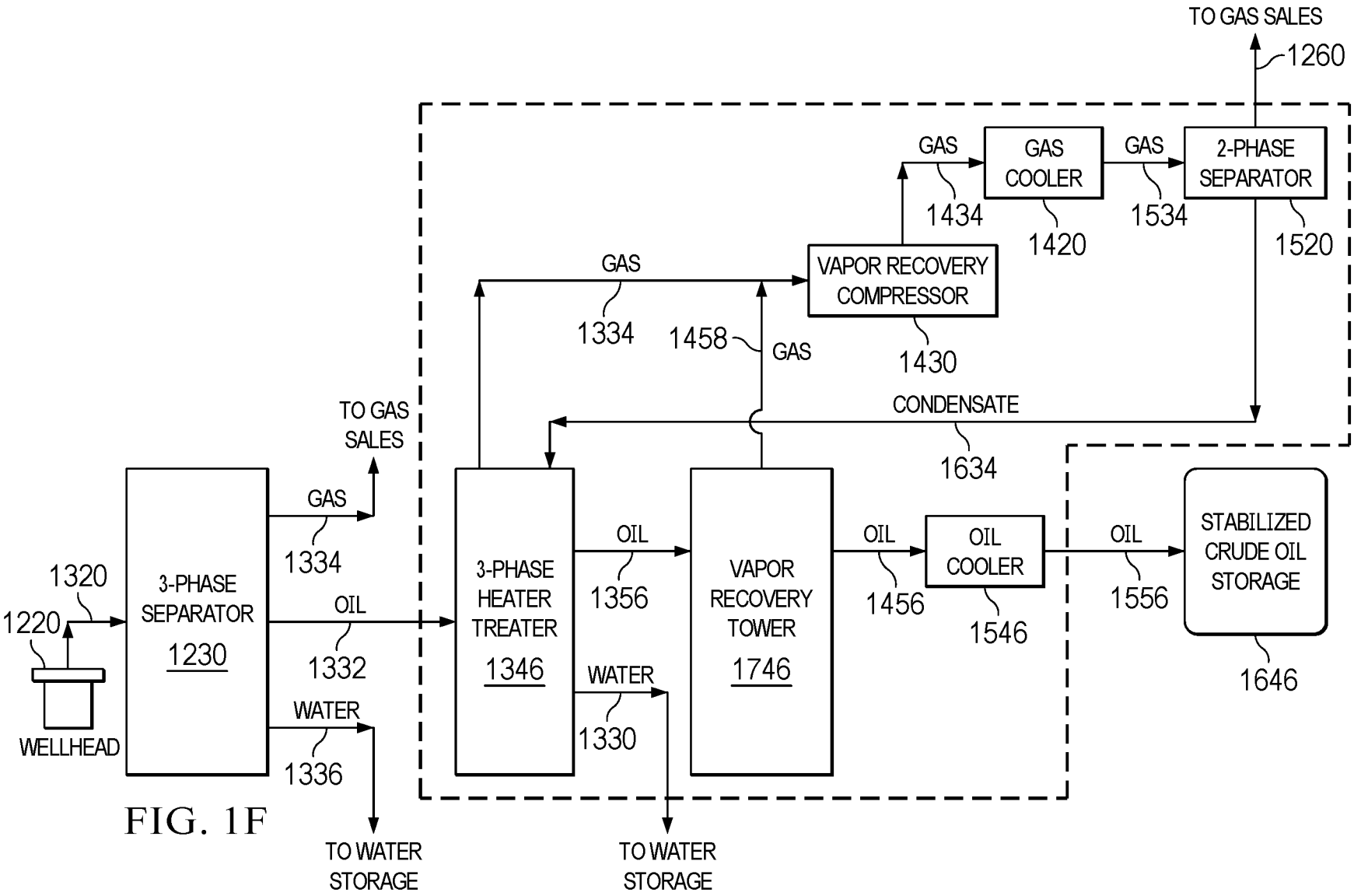

FIG. 1F shows a simple diagram of a production facility using a vapor recovery tower to capture emissions of produced oil. This figure is similar to FIG. 1D. Produced oil from 3-phase separator 1230 sends oil to heater treater in stream 1332. Heater treater will operate at a pressure to send the produced oil stream 1356 to the vapor recovery tower 1746. Produced gas from the heater treater 1346 will flow directly to the vapor recovery compressor 1430 to be compressed and cooled. Condensate 1634 produced from the 2-phase separator 1520 will be sent to the heater treater 1346 to cross exchange with the heater treater vapor space. Produced oil stream 1456 from vapor recovery tower 1746 will flow directly to oil cooling. Gas stream 1458 produced from vapor recovery tower 1746 will be comingled with gas stream 1334 from the heater treater to be sent directly to the vapor recovery compressor.

Figure 2A:
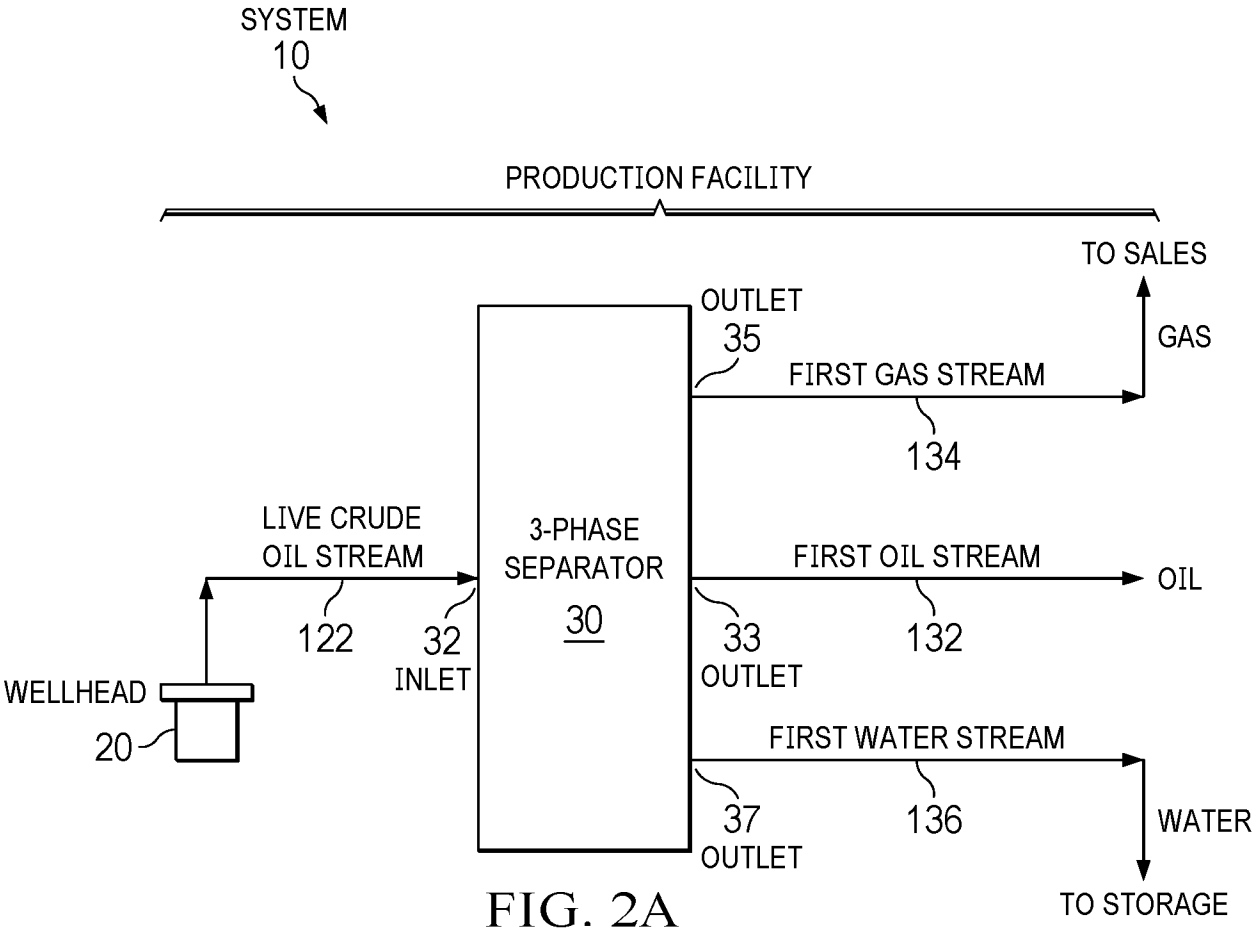

FIG. 2A is a simplified flow process diagram of a first portion of a first example of a live crude oil conditioning process using a 3-phase separator.

Figure 2B:
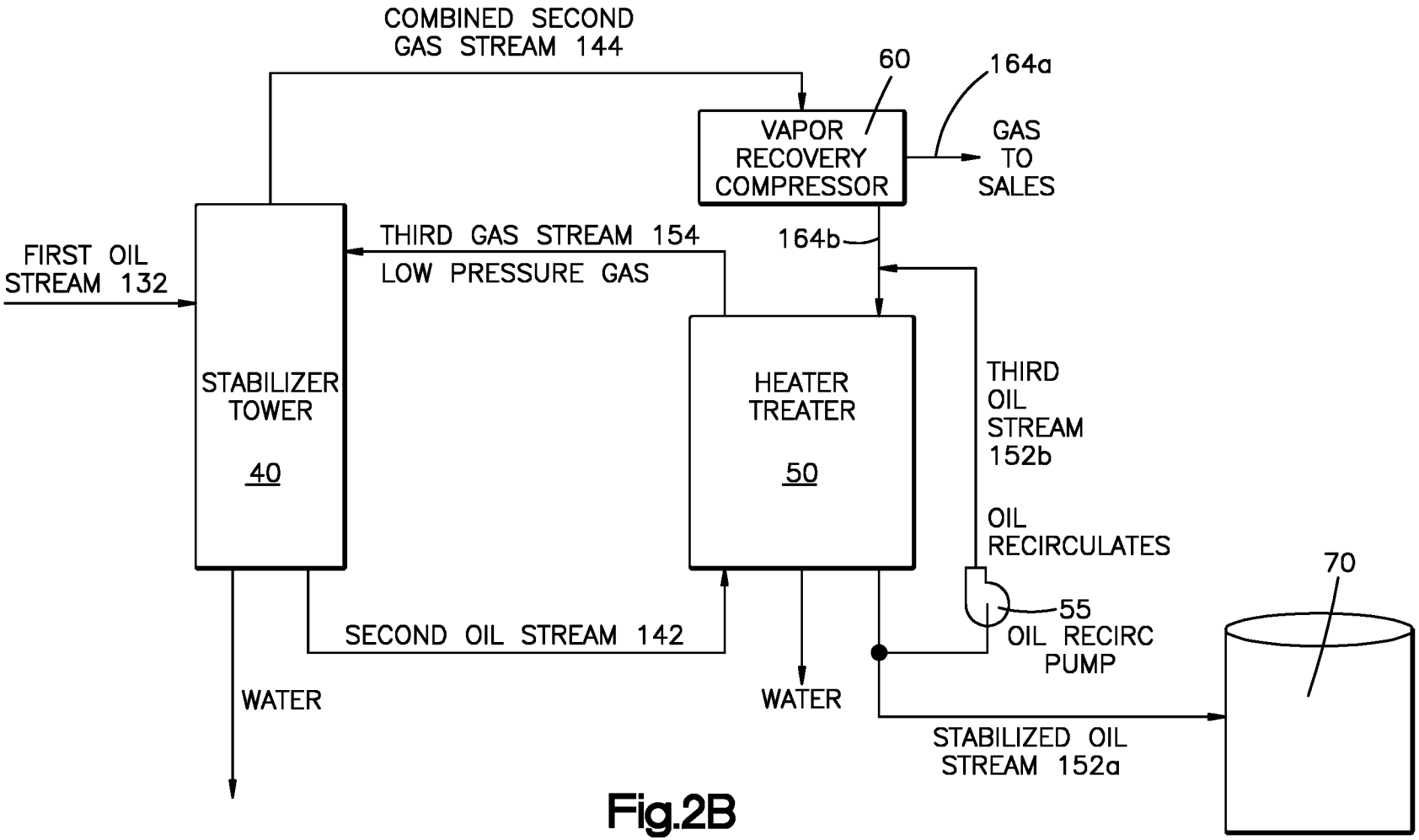

FIG. 2B is a simplified flow process diagram of a second portion, down-stream of the portion shown in FIG. 2A, of the example of a live crude oil conditioning process.

Figure 2C:
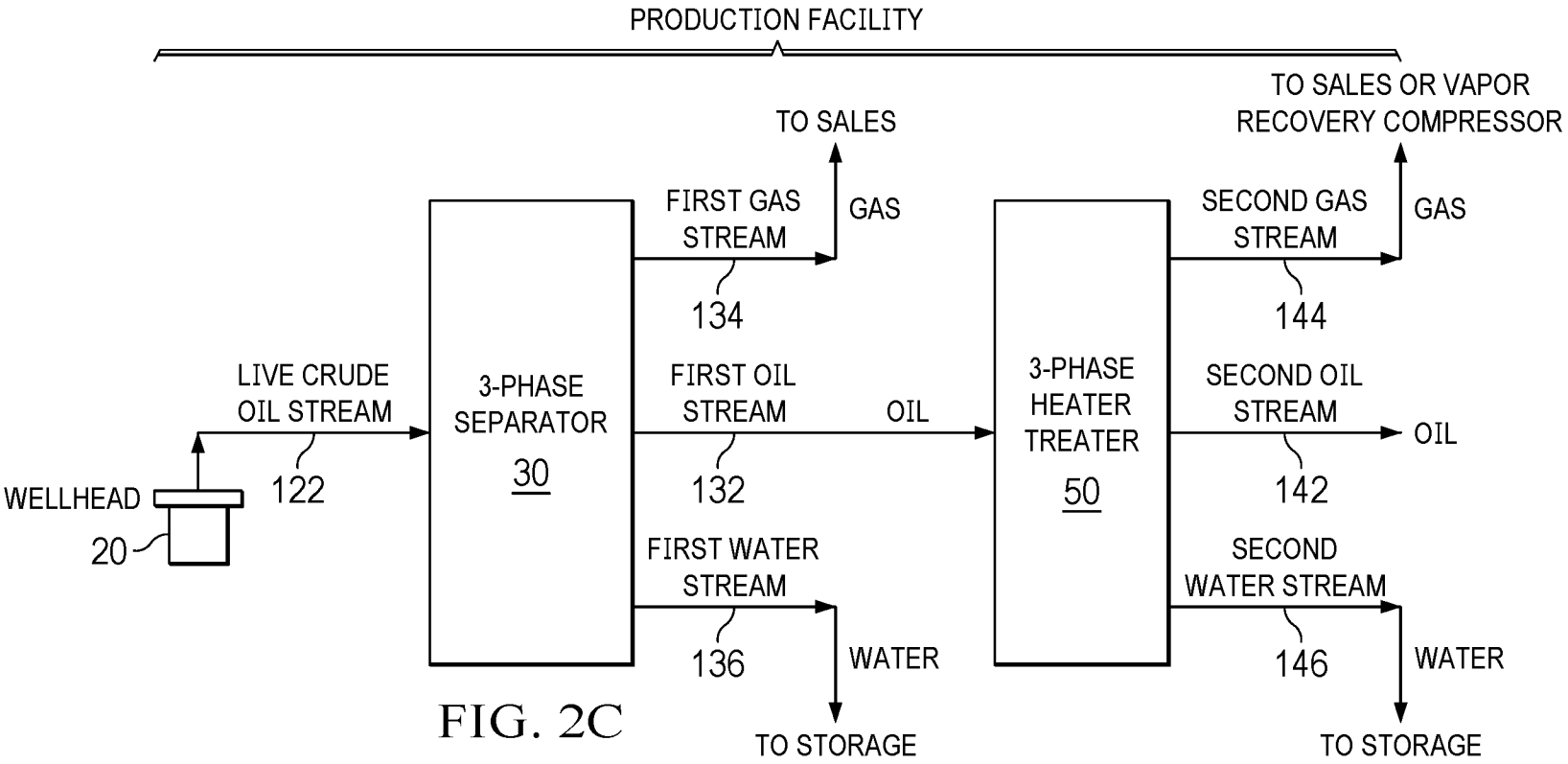

FIG. 2C shows an example for another type of a production facility. This involves a 3-phase separator that sends separator oil from the wellhead emulsion to a 3-phase heater treater. A heater treater is used as secondary treatment for the produced oil. A heater treater vessel adds heat to the fluids and gas inside and to get further separation of water and gas out of the oil. Gas from the heater treater typically comingles with the cold 3-phase separator and goes to gas sales or goes to a vapor recovery compressor to raise pipeline pressure to send gas to sales if the heater treater is not operating at a sufficient pressure to send to sales.

Figure 2D:
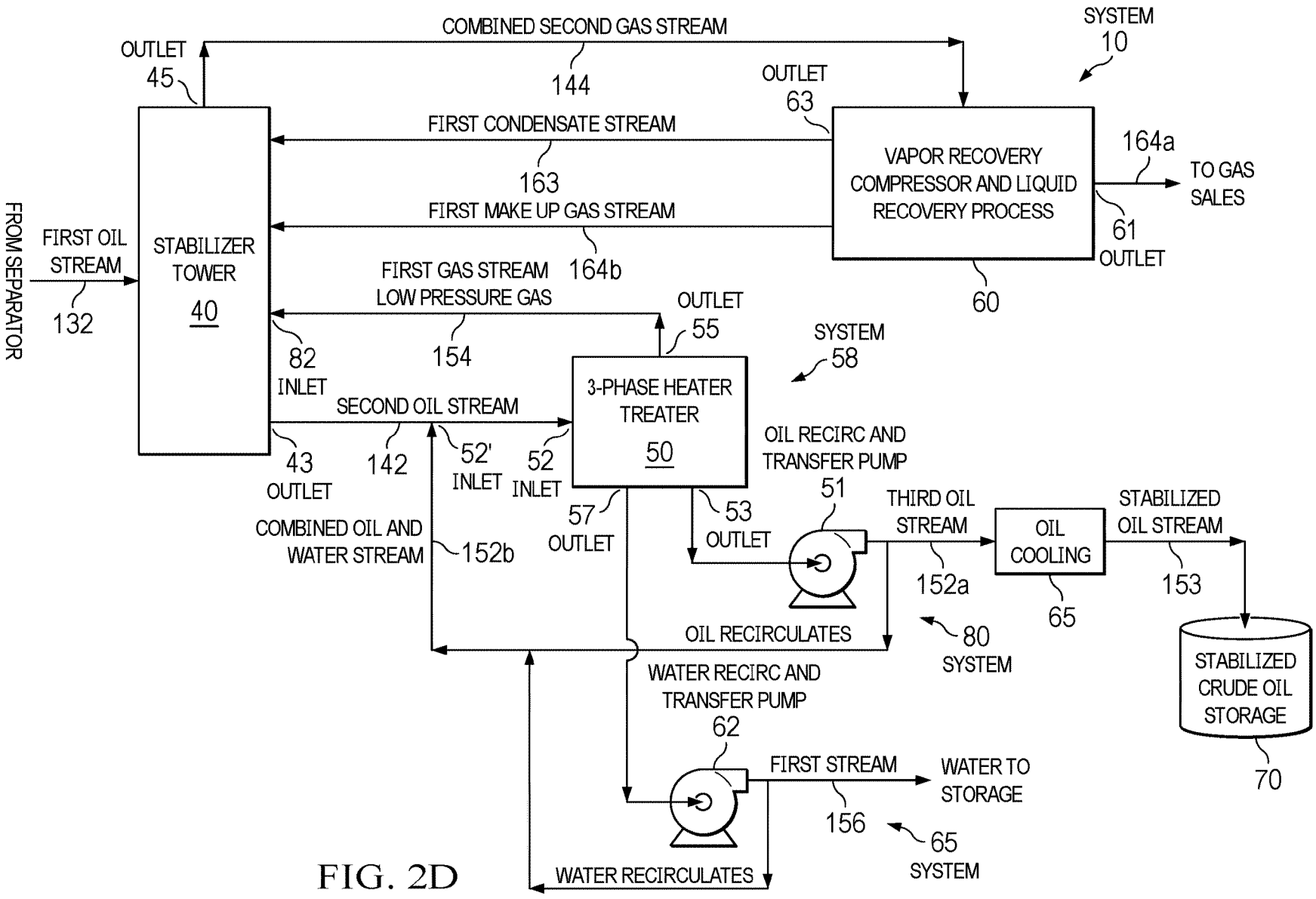

FIG. 2D shows a basic flow diagram of the zero emissions system. Stabilizer tower upstream of heater treater. Oil and water pumps recirculate fluids in the heater treater and transfers oil to oil cooling and oil storage, and water to water storage. A gas stream first make up gas stream 164*b*, is used to balance the stabilizer tower and add gas to the tower and keep a desired oil to gas ratio inside the tower. This keeps an efficient amount of gas inside the tower to contact the oil stream when oil inlet volumes decrease. Oil stream 153 is a stabilized oil stream from oil cooling to oil storage. Water pump 62 transfers water from heater treater to either water storage or will recirculate water to the inlet of the heater treater.

Figure 2E:
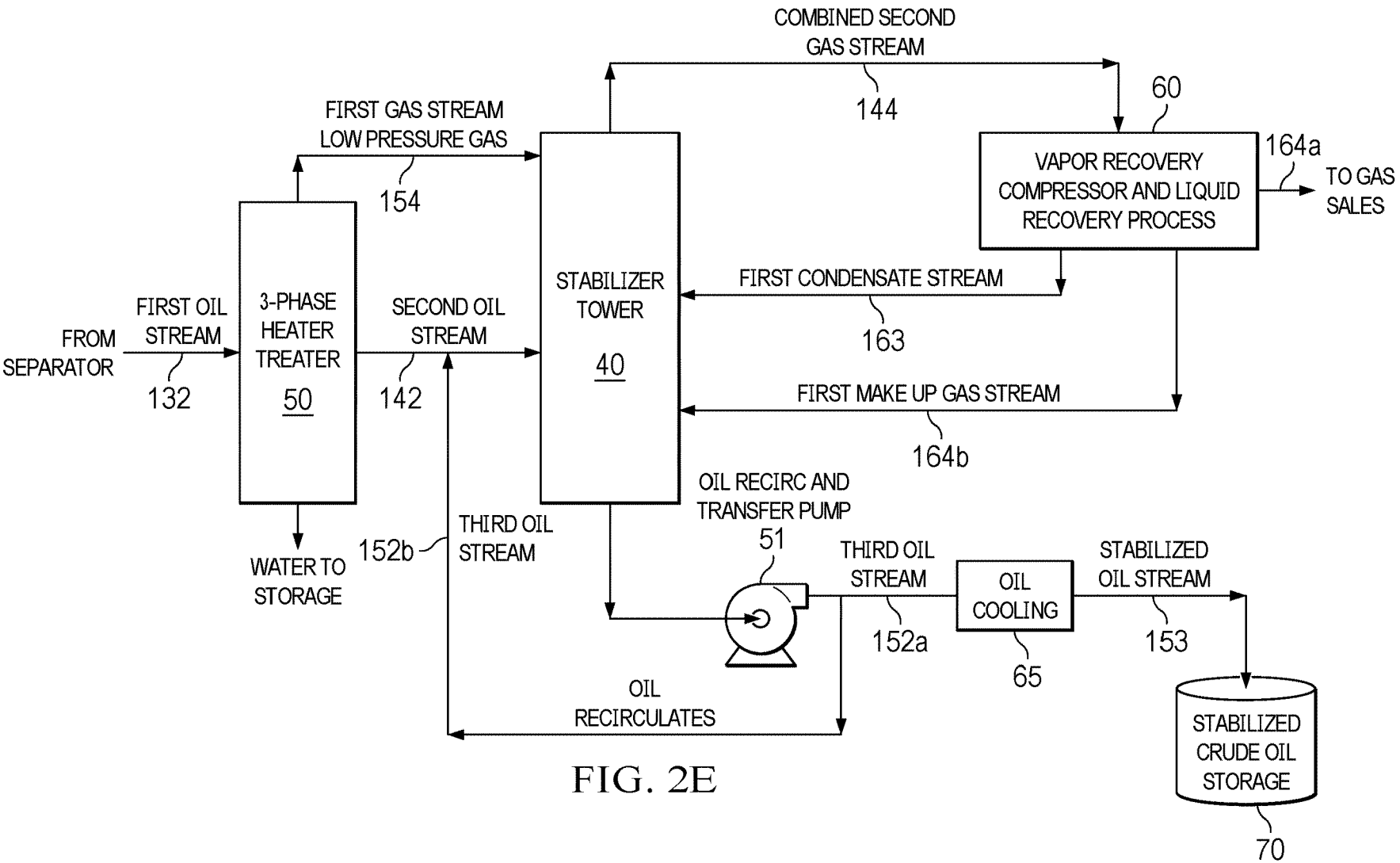

FIG. 2E shows a basic flow diagram of the zero emissions system and is similar to FIG. 1D. Heater treater upstream of the oil stabilizer tower. The heater treater internal pressure will send gas and oil to the stabilizer tower. Oil pumps recirculate fluids in the tower and transfers oil to oil cooling and oil storage. The oil stabilizer is the only vessel operating at low pressure.

Figure 3A:
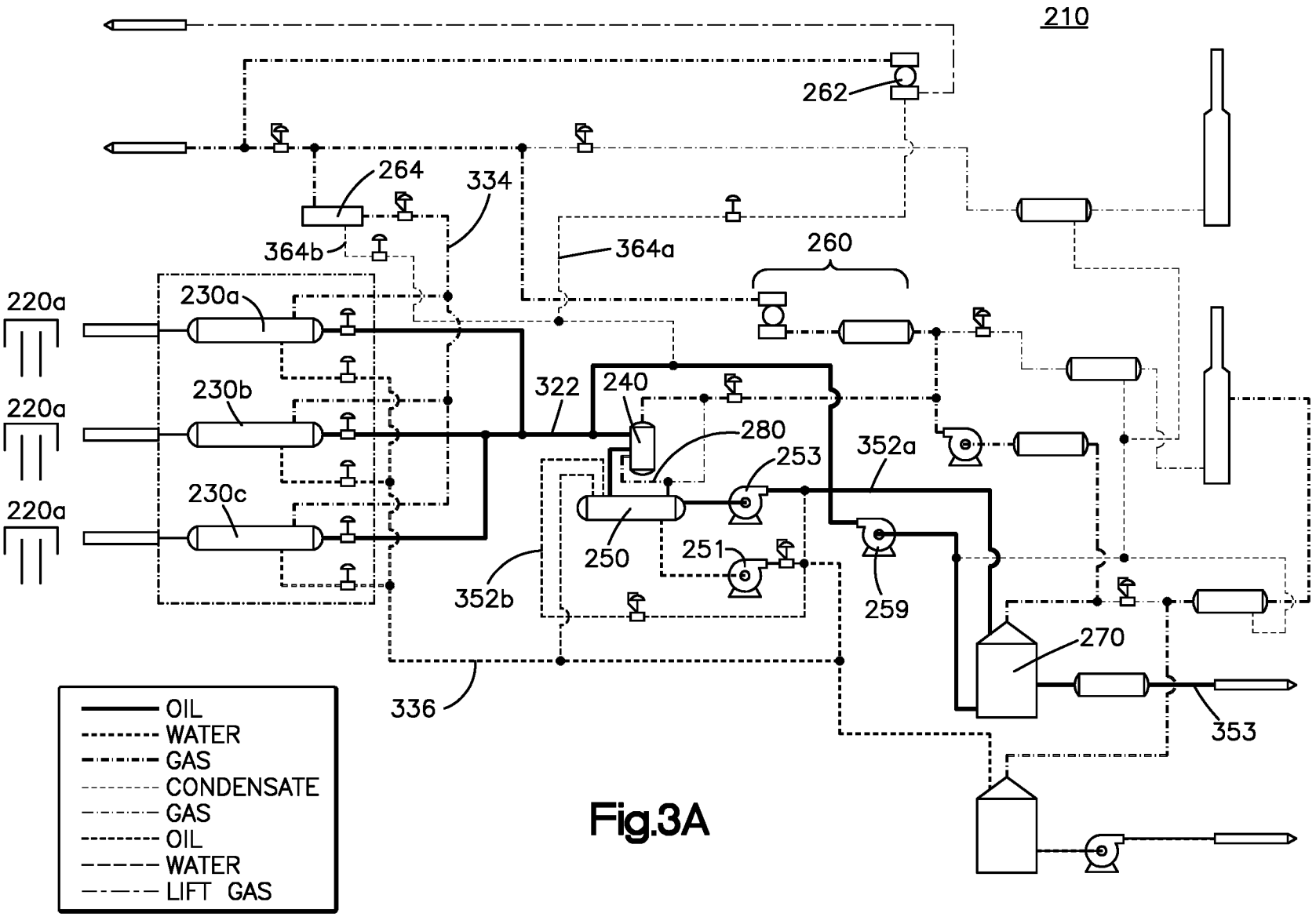

FIG. 3A is a flow process diagram of a second example of a live crude conditioning process.

Figure 3B:
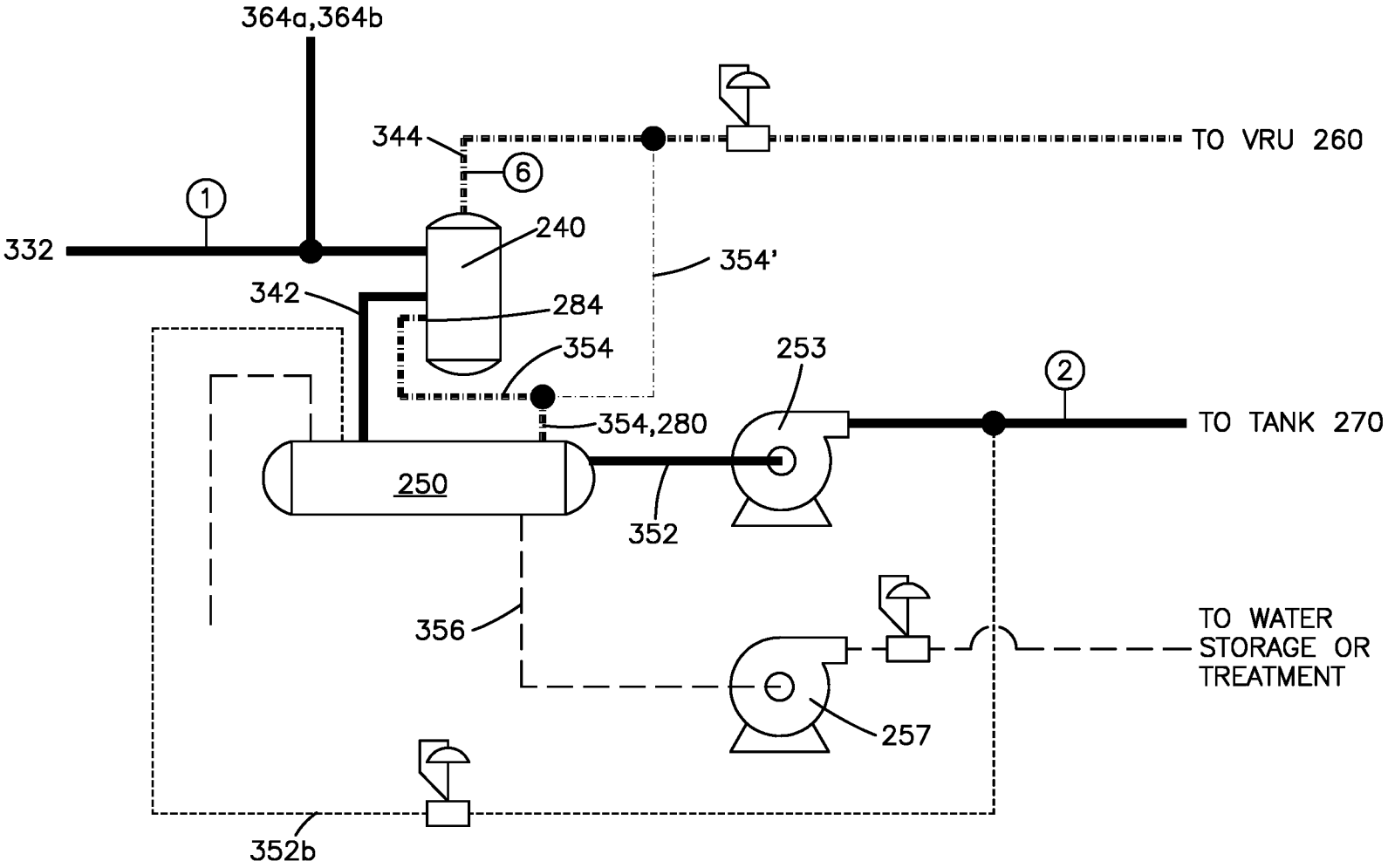

FIG. 3B is an enlarged portion of the flow process diagram of FIG. 3A.

Figure 3C:
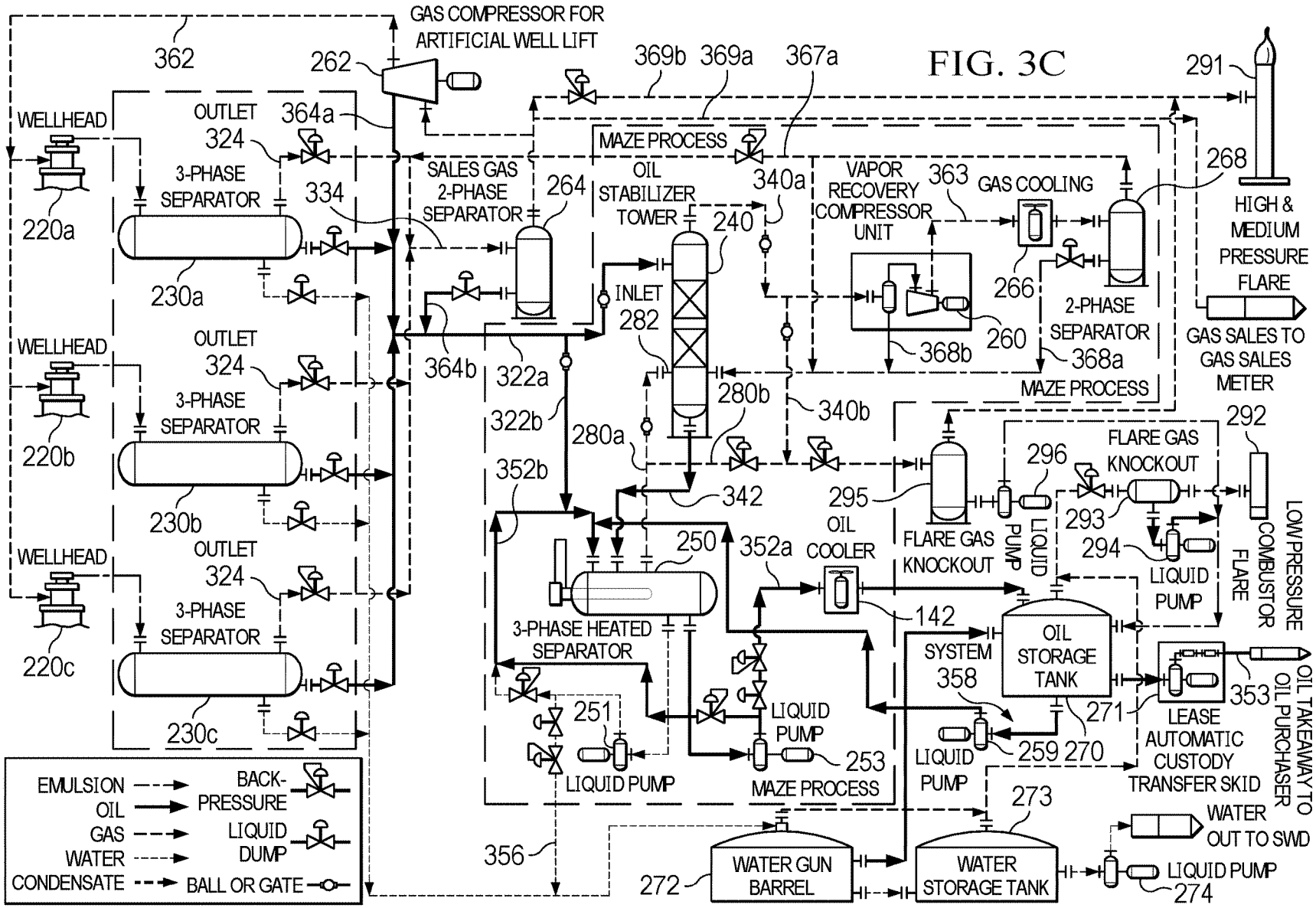

FIG. 3C shows a typical production facility process flow diagram with an oil stabilization tower process to reach zero tank emissions. Oil stream 322*b* bypasses stabilizer tower to send oil to heater treater inlet. Water pump 251 transfers water to water storage or recirculates water to heater treater inlet. Oil pump 253 transfers oil to oil storage or recirculates oil to heater treater inlet. Gas stream 362 from a compressor unit that injects high pressure gas down the tubing of a well head for artificial wellhead lift in attempt to add pressure in a well to get fluids to rise up casing of well head and transfer the emulsion produced from a wellhead to the separator. Gas stream 363 sent to a gas cooling process from the vapor recovery unit 260 to extract liquids out of the gas stream.

Figure 3D:
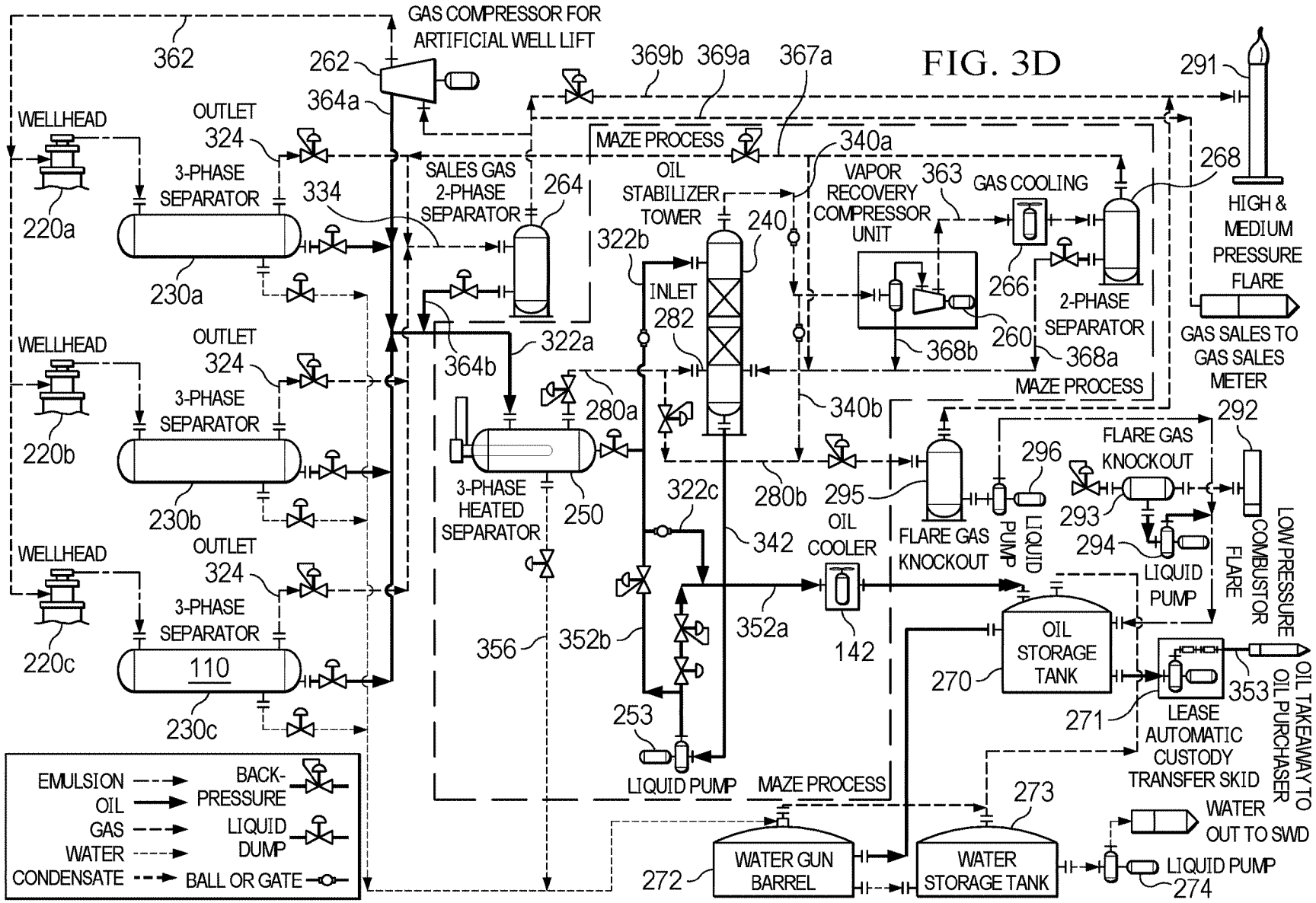

FIG. 3D is similar to the facility process described in FIG. 3C except using the maze process described in FIG. 1D and FIG. 2E.

Figure 3E:
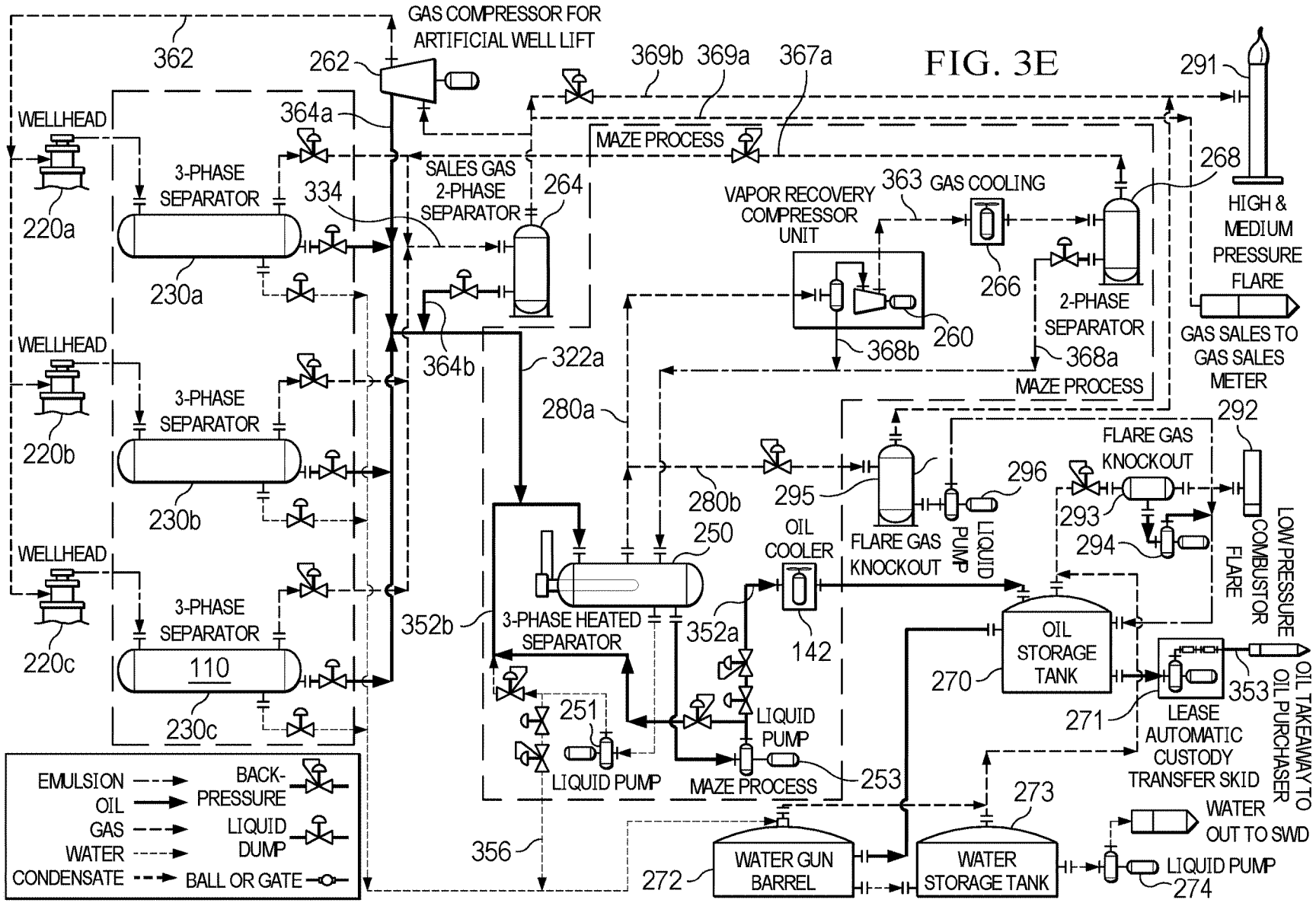

FIG. 3E is similar to the facility process described in FIG. 3C except using the maze process described in FIG. 1E.

Figure 3F:
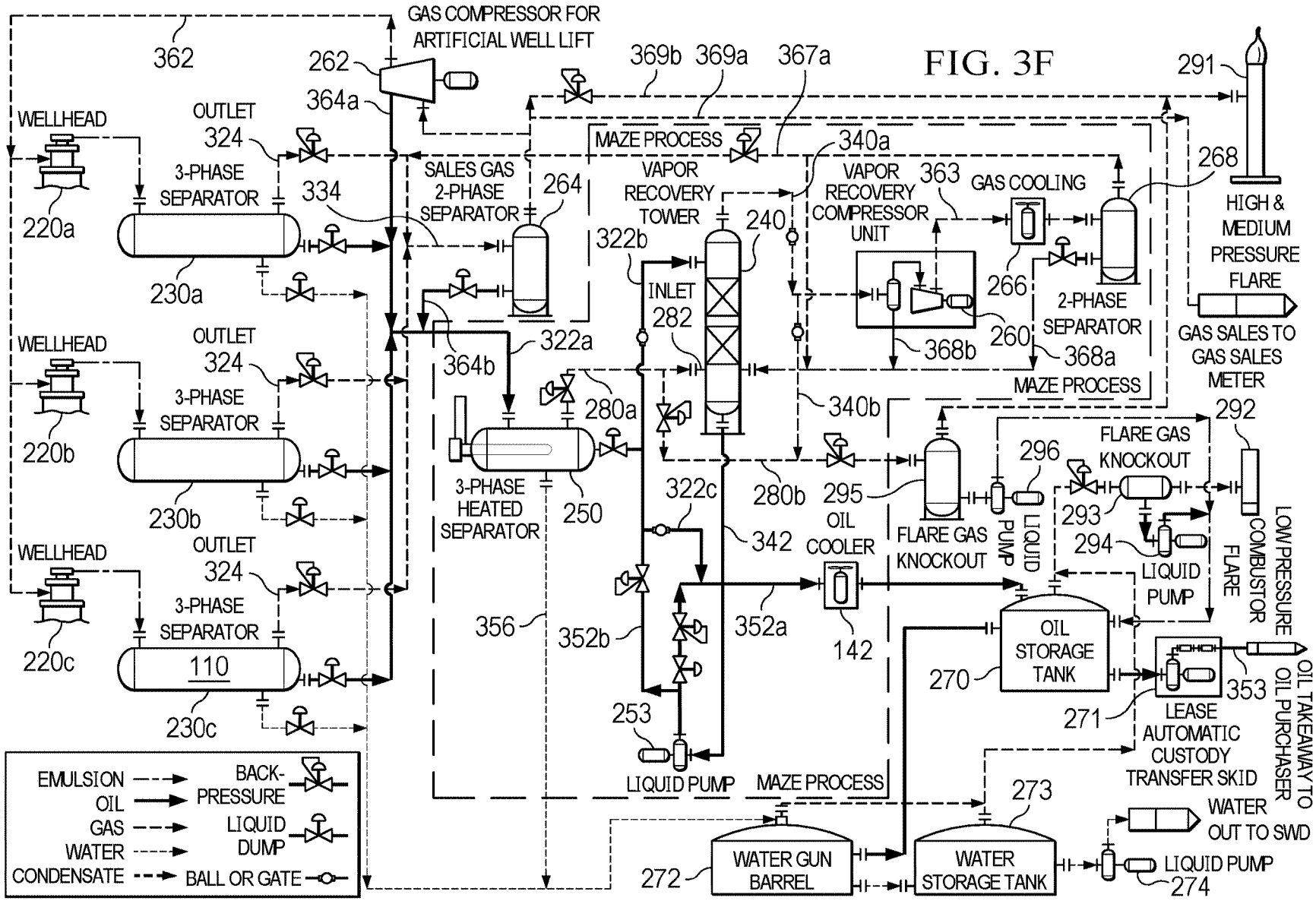

FIG. 3F is similar to the facility process described in FIG. 3C except using the maze process described in FIG. 1F.

Figure 4A:
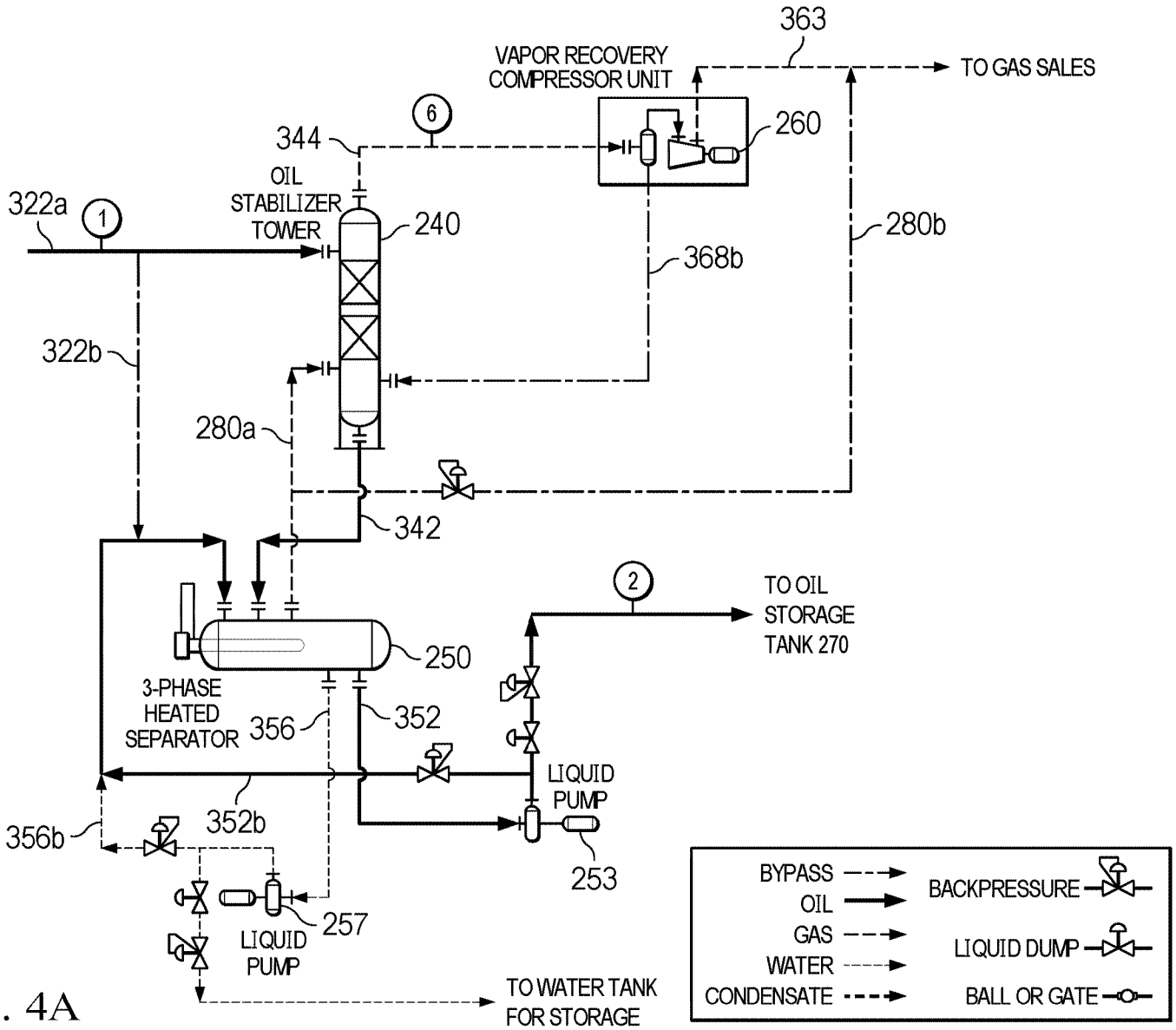

FIG. 4A shows a process for reducing emissions. This process produces zero emissions and no swell. Since swell is not generated from the compression and cooling process off the vapor recovery compressor, oil cooling is not needed to reach zero emissions. Oil outlet stream 352 sends oil to oil storage from heater treater. Recirculating water stream 356*b* from water pump on heater treater.

Figure 4B:
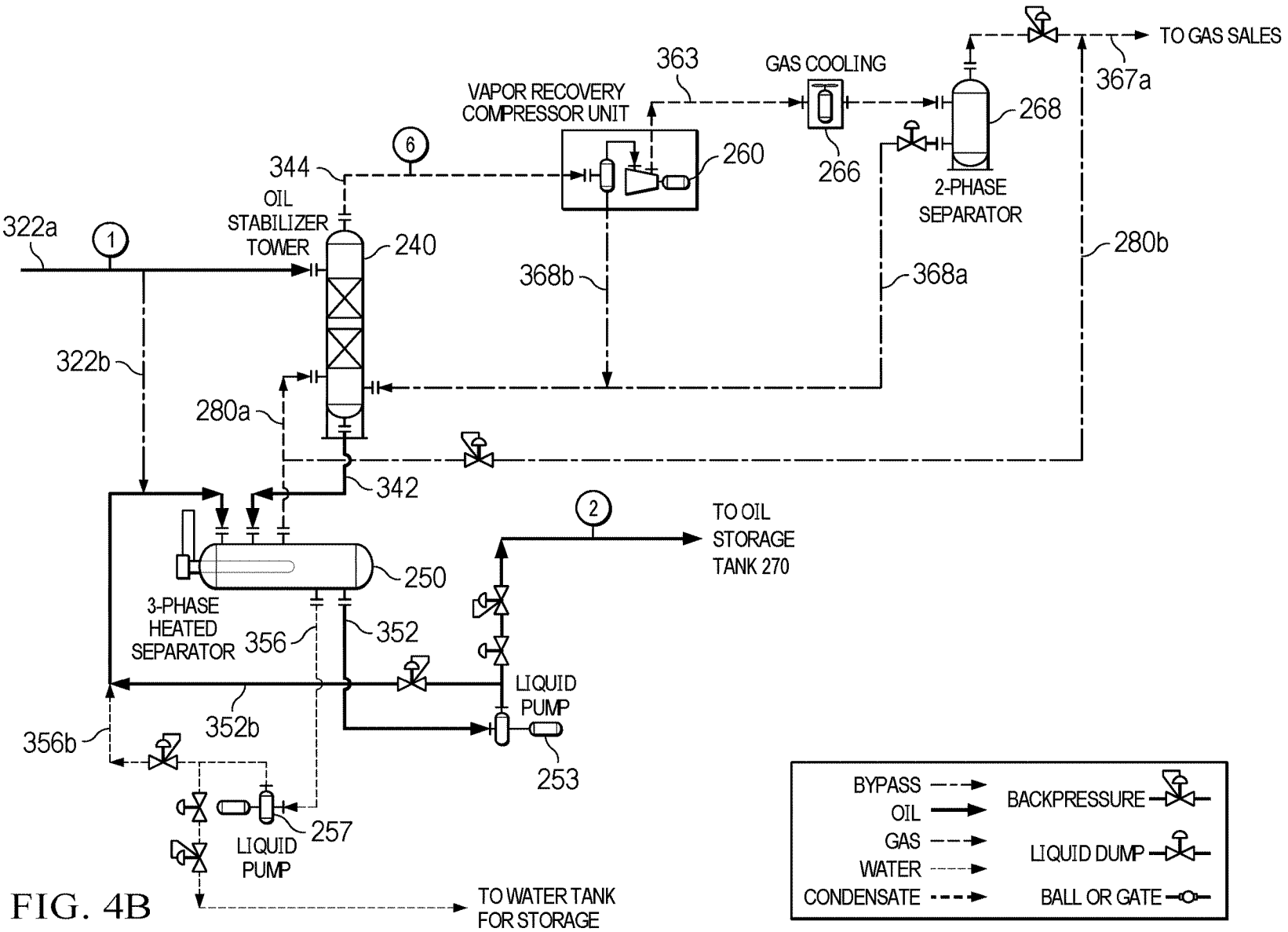

FIG. 4B shows a process for reducing emissions. Oil cooling is not always needed as the heater treater 250 temperature can be increased to make more gas escape from the oil phase in the process and reach near to at zero emissions.

Figure 4C:
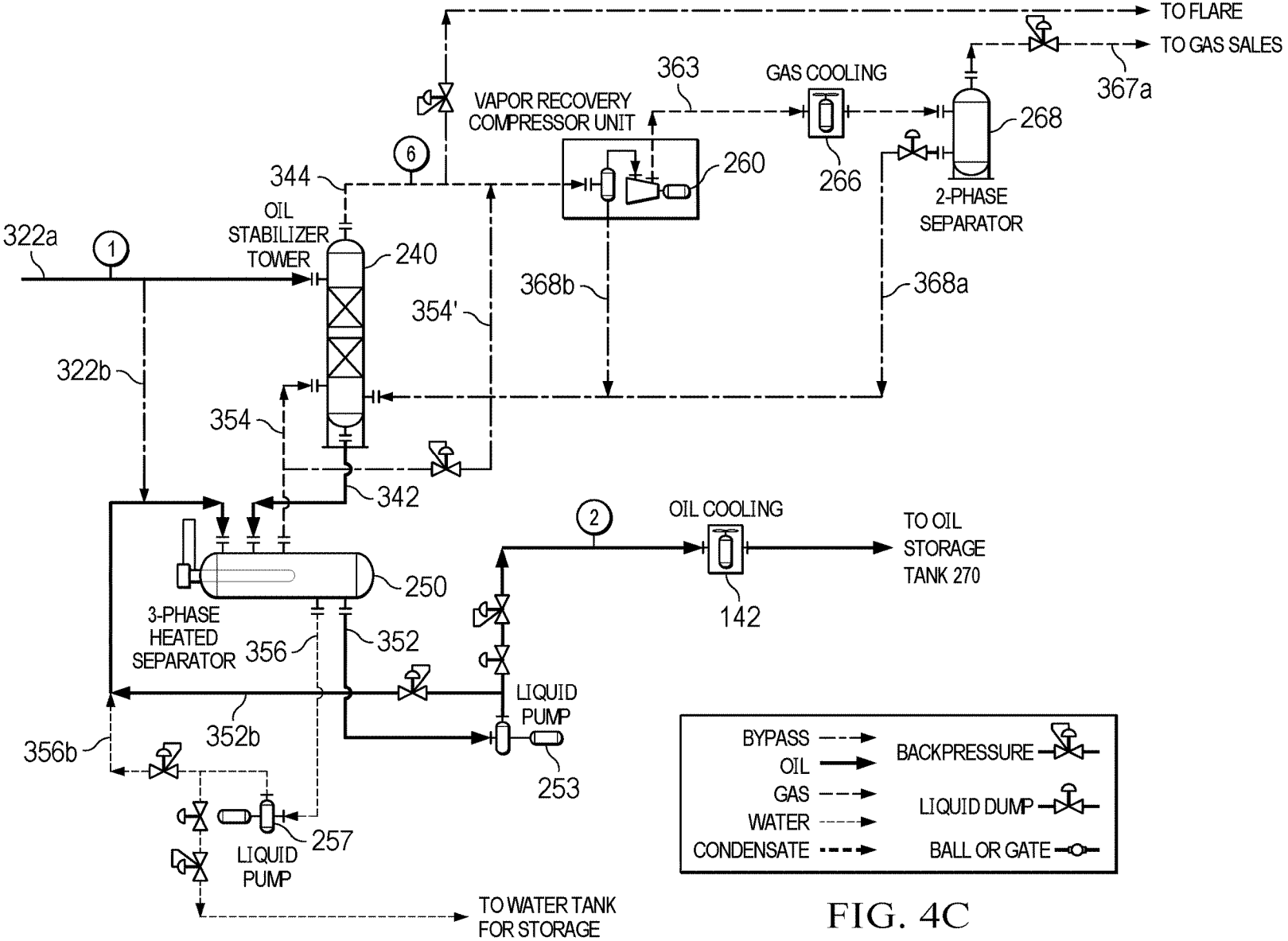

FIG. 4C shows a process for reducing emissions. This process is used and described in FIG. 1C, FIG. 2D, FIG. 3C.

Figure 4D:
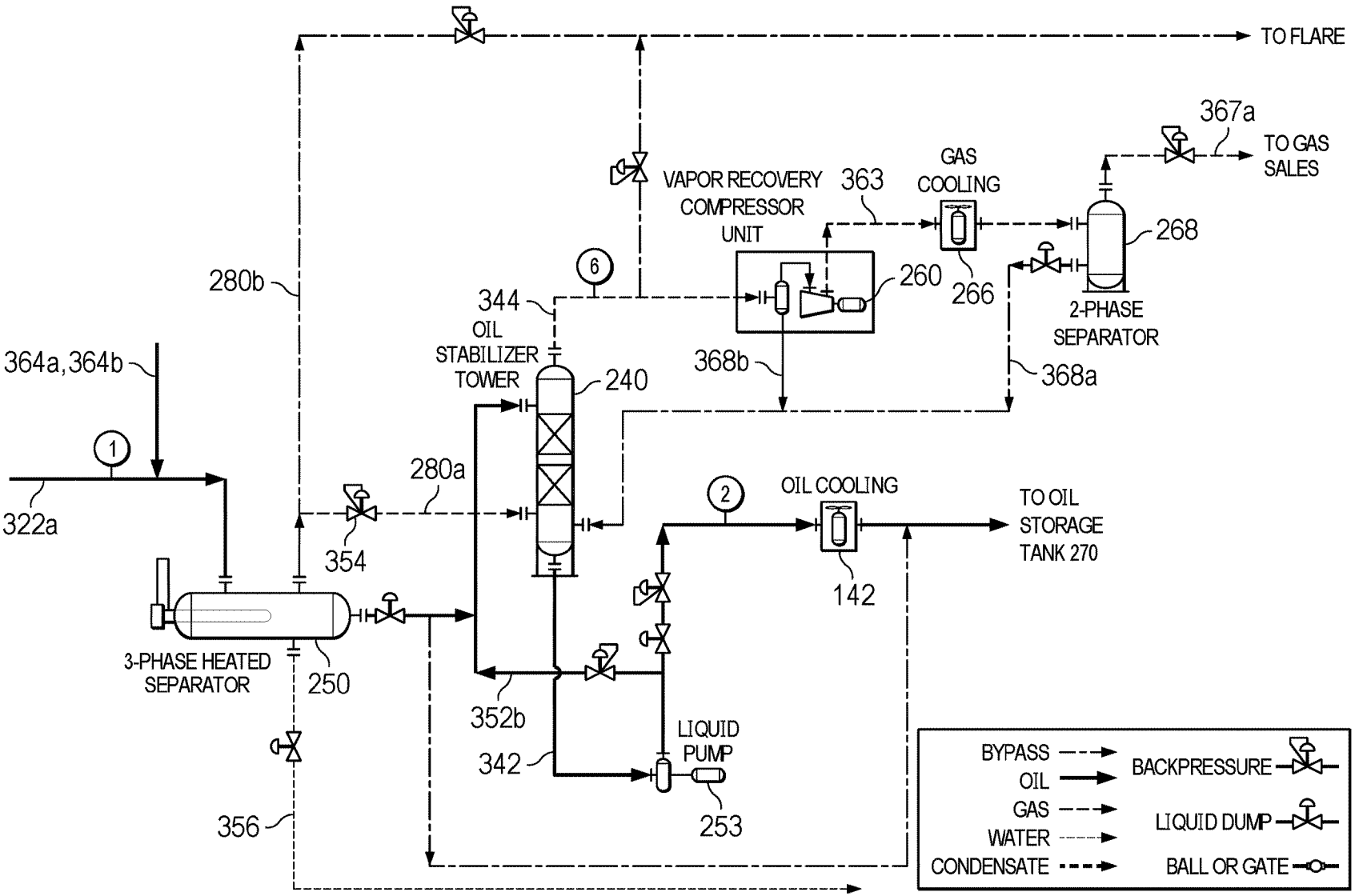

FIG. 4D shows a process for reducing emissions. This process is used and described in FIG. 1D, FIG. 2E, FIG. 3D.

Figure 4E:
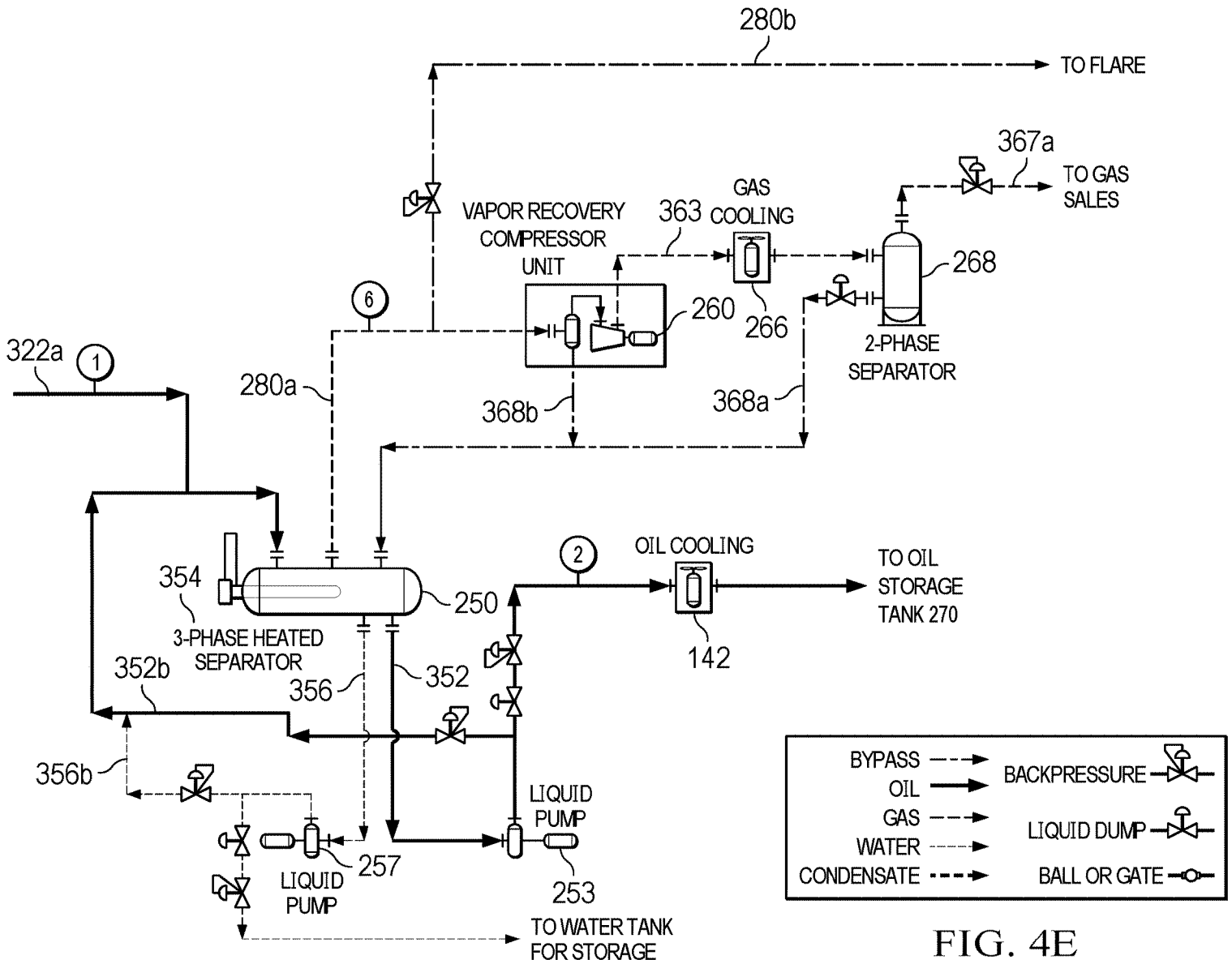

FIG. 4E shows a process for reducing emissions. This process is used and described in FIG. 1E and FIG. 3E.

Figure 4F:
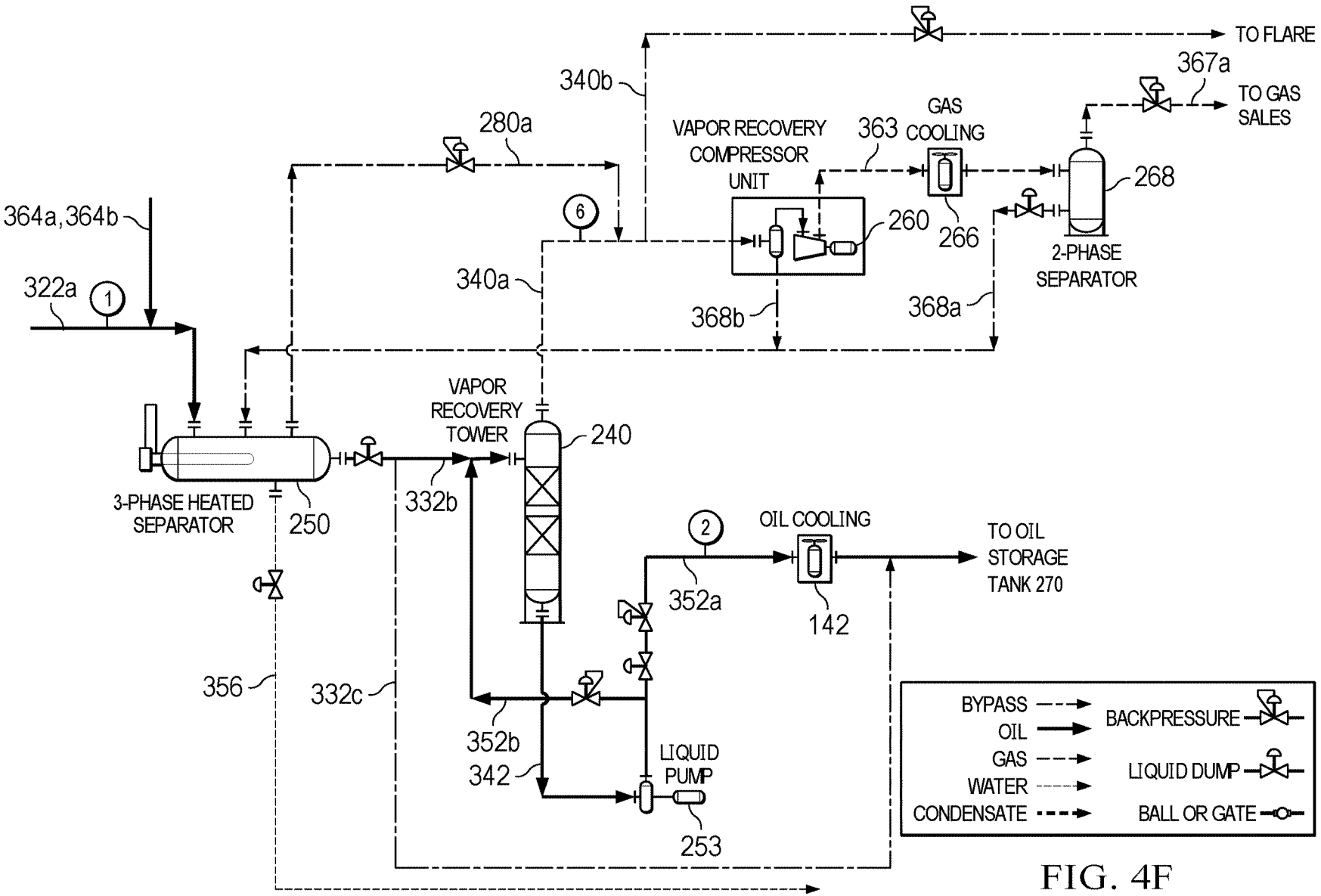

FIG. 4F shows a process for reducing emissions. This process is used and described in FIG. 1F and FIG. 3F.

DETAILED DESCRIPTION OF ILLUSTRATIVE EMBODIMENTS

To illustrate a first example of a system for stabilizing crude oil, a system 10 for stabilizing live crude oil includes a separator 30, a stabilizer such as a stabilizer tower 40, a heater treater 50, a vapor recovery unit 60, a stabilized oil tank 70, and an oil and gas recirculation system 80.

As illustrated in FIG. 2A, separator 30 receives a first oil stream 122 from a wellhead 20 at inlet 32. First oil stream or live crude feed 122 typically includes an emulsion of oil, gas, and water directly from wellhead 20. The terms "first oil stream" and "live crude oil" encompasses any conventional wellhead pressures and temperatures and composition of hydrocarbons, according to API specifications. In this regard, wellhead pressures range from 2,000 to 150,000 psi (138 to 10,300 bars). Further the terms "first oil stream" and "live crude oil" encompass any conventional oil and gas stream from a wellhead, including but not limited to emulsions, such as with water or other liquid. It is understood that several wellheads 20 can feed a single separator 30, and the symbol in FIG. 2A for separator 30 can represent several separators in parallel.

Separator 30 is illustrated in FIG. 2A as a vertical separator, including a stream carrying live crude 122 to the top half of the separator 30. The separator 30 produces a separator oil outlet stream 132 (also referred to herein as a first oil stream) at an oil stream outlet 33, a separator gas outlet stream 134 (also referred to herein as a first gas stream) at a gas stream outlet 35, and optionally a separator water outlet stream 136 (also referred to herein as a first water stream) at a water outlet 37. The separator water outlet stream is optional, as system 10 encompasses two phase and three phase separators.

Separator 30 may, in some vertical, three-phase configurations, include an inlet diverter and a mist eliminator, an oil level controller and oil dump valve, and a water dump valve. Separator 30 may also (or alternatively) include a downcomer and spreader, an interface controller and water dump valve, and oil weir level controller and oil dump valve. Other configurations of separator 30 and/or multiple stages may be employed. Separator 30 is not limited to vertical separators, as other configurations, such as horizontal separators, may be employed. Separator 30 often is near the one or more wellheads 20, often as close as can be conveniently located. Separator 30 often can be remotely located, such as a mile from the wellhead 20.

Stabilizer tower 40 yields a stabilizer oil output stream 142, also referred to as second oil output stream 142, from an oil outlet 43. Accordingly, stabilizer tower 40 can include a liquid level controller and corresponding valves and instrumentation for operating stabilizer tower 40 as a two-phase process.

The design features of separator 30 may be chosen and designed according to the process conditions, such as pressure, temperature, and live crude feed characteristics, and according to industry standards, as will be understood by persons familiar with oil and gas stabilization. Further, it is understood that separator 30 may include piping, valves, controls, and the like to perform its separation function, such as a gas back pressure valve, flare valve, a gas flow measurement device, and the like in the separator outlet gas stream piping.

Of the separator output streams, gas stream 134 is typically suitable for use and can thus be sold to end users, and water stream 136 typically goes for water treatment, reinjection, or the like. As illustrated in FIG. 2B, oil stream 132 goes to stabilizer tower 40.

Pressure within stabilizer tower 40 typically is controlled by a gas back-pressure valve (or the like) to a pressure that often is no more than approximately 200 psi (14 bar). The liquid within tower 40 flows by gravity through a series of trays, packing, and/or other media for stripping off gas from the liquid. In this regard, the internal components of stabilizer tower 40 may be chosen and configured in any way, as will be understood by persons familiar with oil stabilization and stabilizer tower technology.

As described more fully below, stabilizer tower 40 includes an inlet 82 for receiving a heater treater gas output stream 154. Thus, the gas output of stabilizer tower 40 is referred to as a combined gas stream 144, also referred to as a combined second gas stream 144, as a gas outlet 45.

Vapor recovery unit (VRU) 60 includes a compressor, often a screw type, that receives the combined gas stream 144 from stabilizer tower gas outlet 45. VRU 60 can also include a demister, valves and controls, other conventional components. VRU packages are commercially available, as will be understood by persons familiar with oil stabilization technology.

Liquid from the compression is discharged from VRU 60 at an oil outlet 63 to yield a VRU output oil stream 163 (that is, condensate), which can be controlled to be approximately at heater treater pressure. Oil stream 152*b* enters into heater treater 50 at an oil inlet 52', which may be separate from heater treater inlet 52 that receives stabilizer tower oil output stream 142.

Gas that is pressurized to a desired pressure in VRU 60 is discharged at a gas outlet 61 to yield a VRU gas output stream 164*a* that may be piped to an end user, accumulated with other gas streams, such as separator output gas stream 134, and/or gas streams from other sources.

Heater treater 50 is illustrated in FIG. 2B as a horizontal heater treater. Heater treater 50 includes an inlet 52 for receiving stabilizer oil output stream 142, which typically is an emulsion of water, oil, and gas at approximately the stabilizer tower pressure. Heater treater 50 may include an oil dump valve, a gas back-pressure valve, a water dump valve and like process equipment and its instrumentation, as will be understood by persons familiar with heater treater technology in view of the information herein. Heater treater 50 may be of any type, such as vertical or horizontal, and may include combination of valves and their actuation, such as mechanical and pneumatic actuation. Chemical agents may be used to weaken the emulsifying agents, depending on the chemistry of the fluid in the heater treater, the process conditions, and the desired output properties.

Heater treater 50 also includes a burner system 58 that typically includes a burner, a fire tube, a burner management system, and a stack. The burner management system includes a thermostat, a gas burner valve, and a safety system for controlling temperature in the process, such as fluid temperature within heater treater 50. The fire tube is an indirect-type heat exchanger within heater treater 50 that transfers heat to the process fluid. The products of combustion exit the fire tube through the stack.

Thus, after initial degassing in the inlet portion of heater treater 50 near inlet 52, heat from the fire tube is transferred to the process fluid within heater treater 50, which raises the process temperature to (typically) 100 to 160 degrees F. Heating the emulsion in this regard decreases fluid viscosity, enhances the separation of water from the oil, and promotes gas release. Gas from the initial degassing and gas stripped from the emulsion via heating can be combined to yield a heater treater gas output stream 154, which is also referred to herein as third gas stream 154. As explained more fully below, gas output stream 154 is circulated back to recirculation gas inlet 82 of stabilizer tower 40 from a gas outlet 55 of heater treater 50.

Processing within heater treater 50 yields a stabilized oil output stream 152*a* at an oil outlet 53 and a water output stream at a water outlet 57. Stabilized oil output stream 152*a* is at a temperature and pressure that enables it to be sent to and stored in a stabilized crude oil tank 70 that is at atmospheric pressure.

A portion, referred to herein as the oil recirculation stream 152*b* and the third oil stream 152*b*, of the oil output from heater treater 50 is recirculated from heater treater oil output 53 to oil inlet 52' where preferably it is combined with VRU oil output stream 163. As referred to above, the recirculation system 80 includes the oil recirculation stream 152*b*. A pump 59 (shown in FIG. 2B) moves oil recirculation stream 152*b* from heater treater oil outlet 53 to the second heater treater oil inlet 52'. Recirculation of oil via oil recirculation stream 152*b* is believed to enhance the conditioning process by increasing the volume of oil that is subject to treatment in heater treater 50.

Recirculation system 80 also includes gas recirculation stream 154 that is piped from heater treater gas outlet 55 to a stabilizer recirculation gas inlet 82. Typically, heater treater pressure is greater than stabilizer tower pressure, such that gas recirculation stream 154 is moved via the pressure difference without requiring additional components, such as a compressor. Typical pressures in the stabilizer tower 40 and heater treater 50 typically are between 5 and 150 PSI (0.4 and 10.4 bars), according to the desired operating conditions.

The inventors have demonstrated that oil stabilization process 10 enhances the volumetric flow rate of stabilized oil stream 152*a*. It is surmised that low pressure gas stream 154 from the heater treater flowing upwardly in stabilizer tower 40 in close contact with the oil emulsion dissolves or entrains gaseous hydrocarbons in the liquid stream, even while partial fractionation or distillation of the oil occurs in stabilizer tower 40 at typical stabilizer process conditions, such as 50 to 200 PSIG (3.4 to 14 bars), while retaining pentane and other higher hydrocarbons (such as C5+). Accordingly, it is believed that that fuel heating value and commercial value of stabilized oil stream 152*a* is not unduly adversely affected.

To illustrate a second example of a system for conditioning crude oil, a system 210 for conditioning (stabilizing) live crude oil includes separators 230*a*, 230*b*, and 230*c*, a stabilizer such as a stabilizer tower 240, a heater treater 250, a vapor recovery unit and scrubber 260, a stabilized oil tank 270, and an oil and gas recirculation system 280. Each of the components of system 210—including separators 230*a-c*, stabilizer 240, heater treater 250, components of vapor recovery unit and scrubber 260, and recirculation system 280—have a structure and function as generally described with respect to corresponding components of first embodiment conditioning system 10.

As illustrated in FIG. 3A, each of three wellheads 220*a*, 220*b*, and 220*c* provide live crude to a corresponding separator 230*a*, 230*b*, and 230*c* (respectively). In embodiment of FIG. 3A, as set out in Table 1, the total live oil feed 222 to the three separators 230*a*, 230*b*, and 230*c* from the wellheads includes 3,450 BPD of oil and 6,000 MSCFD of gas. The live oil feeds in the embodiment of FIG. 3A has a pressure of 180 PSIG (12.4 bars) and a temperature of 90 degrees F. The outlets from 230*a*, 230*b*, and 230*c* are illustrated as oil stream 322, separator outlet gas stream 324, and separator outlet water stream 326. Oil stream 322*a* is at 90 degrees F. and has a pressure of 20 PSIG (1.4 bar), as the separator process results in a pressure decrease. Separators 230*a*, 230*b*, and 230*c* in FIG. 3A preferably are conventional horizontal, three-phase separators.

TABLE 1

(IN REFERNCE TO FIG. 3A)

| | STREAM/EQUIPMENT | | | | | | | |
|---|---|---|---|---|---|---|---|---|
| | WELLHEAD OUTPUT | 322 | 352a | 326 | 369a | 362 | 344 | 371 |
| | Item | | | | | | | |
| | 1 INLET TOTAL FACILITY | 2 STAB OIL INLET | 3 STAB OIL OUTLET | 4 TOTAL WATER TO TANKS | 5 TOTAL GAS TO USER | 6 GAS LIFT TO 3 WELLS | 7 STAB OVERHEAD GAS | 8 OIL TANK FLASH GAS |
| BPD OIL | 3,450 | 3,445 | 3,406 | — | — | — | — | — |
| BPD WATER | 6,900 | 3 | — | 6,897 | — | — | — | — |
| MSCFD | 6,000 | 237 | 220 | — | 6,157 | 1,800 | 298 | 9 |
| TEMP. F. | 90 | 90 | 140 | 119 | 90 | 120 | 87 | 110 |
| PRES. psig | 180 | 20 | 6 | 17 | 175 | 1,200 | 5 | 1 |

TABLE 1-continued (IN REFERNCE TO FIG. 3A)

| | STREAM/EQUIPMENT | | | | | |
|---|---|---|---|---|---|---|
| | 359 | 364a&b | 291 | 292 | 353 | 357 |
| | Item | | | | | |
| | 9 RECYCLE OIL TO STAB | 10 LIQUIDS TO STAB | 11 HP FLARE DESIGN GAS | 12 LP FLARE DESIGN GAS | 13 OIL DELIVERY TO LACT | 14 WATER DELIVERY TO GATHERING |
| BPD OIL | 5,000 | 22 | — | — | 3,260 | — |
| BPD WATER | — | — | — | — | — | 6,897 |
| MSCFD | — | — | 12,500 | 6,290 | — | — |
| TEMP. F. | 100 | 86 | 120 | 120 | — | — |
| PRES. psig | 20 | 25 | 100 | 1 | — | — |

Stabilizer tower 240 yields a stabilizer oil output stream 342 and a stabilizer gas outlet stream 344 at 87 degrees F. and 5 PSIG (0.4 bar). As described more fully below, stabilizer tower 240 includes an inlet 282 for receiving a heater treater gas output stream 354. As illustrated in dashed line, heat treater gas output stream 354' may provide a bypass or a partial bypass around stabilizer 240 for all or a portion of gas stream 354.

Vapor recovery unit (VRU) 260 includes a pair of packaged vapor recovery units and a vapor recovery scrubber 10. Condensate stream 364*a* from a gas lift compressor 262 (FIG. 3A) and other process equipment, such as condensate 364*b* from 2-phase separator 264, are fed into stabilizer tower 240. Condensate streams 364*a* and 364*b* in the embodiment shown is 22 BPD at 86 degrees F. and 25 PSIG (1.7 bar).

Heater treater 250 receives stabilizer oil output stream 342. Heater treater 250 yields a gas output stream 354, which as explained above preferably is inserted into stabilizer tower 240 to form recirculation system 280. Heater treater 250 also yields a heater treater oil output stream 352*a* via an oil pump 253 and a heater treater water output stream 356 via water pump 257. Heater treater oil output stream 352*a* (that is, the stabilized oil output of the system 210) is 3,406 BPD at 140 degrees F. and 6 PSIG (0.41 bar). Stabilized oil output stream 352*a* is moved by oil pump 253 to stabilized oil tank 270. The rate of oil stream 353 from tank 370 (item 13 in Table 1 and FIG. 3A) is a factor of the capability of the Lease Automatic Custody Transfer Unit (LACT) and/or downstream customer limitation.

A portion of the heater treater output, an oil recirculation stream 352*b*, may be recirculated from a heater treater oil output 352*a* to oil inlet of the heater treater 250, as controlled by oil pump 253.

An optional recirculation system 358, including an oil pump 259, may circulate stabilized oil from tank 270 to stabilizer 240, as needed to enhance the temperature, pressure, and/or other variables relating to the system. In the embodiment of FIG. 3A, oil recirculation stream 358 is optional and can yield approximately 5,000 BPD at 100 degrees F. and 20 PSIG (1.4 bar). Oil tank output 353 in the embodiment shown is 3,260 BPD.

In some embodiments, compressed gas stream 1434 from the vapor recovery compressor 1430 will be sent to a gas cooling process 1420 (See e.g., FIG. 1C, FIG. 1D, FIG. 1E, and FIG. 1F). Gas cooling can be done typically by a fan and belt cooler and radiator, or sometimes a heat exchanger that will cross exchange hot gas stream 1434 with a cold fluid or gas in attempt to lower gas stream 1434 temperature. Once the desired temperature is reached in gas stream 1434, it will flow into 2-phase separator 1520. By cooling the compressed gas to a desired temperature, it will allow heavy hydrocarbons such as pentanes and other C5+ hydrocarbons to compress into a liquid phase. 2-phase separator 1520 will separate gas from this hydrocarbon rich condensate. The produced gas from 2-phase separator 1520 will be sent to gas sales and the condensate 1634 captured will be returned back to stabilizer tower 1446. Condensate 1634 will enter the bottom of stabilizer tower 1446. When the condensate enters the tower, it will vaporize and rise up the tower to cross exchange with the oil stream coming down the tower in the packaging sections. This will allow the vapor pressure on the hydrocarbon condensate vapor to change and allow the heavy C5+ hydrocarbons to convert into a liquid phase. This process will cause an increased volumetric flow of hydrocarbon liquids in the stabilizer tower and will increase the swell created from the stabilizer tower. Some vapor will remain in the gas phase and comingle with gas stream 1334 to be sent to vapor recovery compressor 1430. This will allow a loop of gas to be recycled to the inlet of the vapor recovery compressor and allow the compressor to have more of a constant flow of gas and keep the compressor running instead of shutting down due to lack of inlet pressure and flow.

In some embodiments, the produced oil 1456 from heater treater 1346 will be sent to an oil cooling process 1546 (See e.g., FIG. 1C, FIG. 1D, FIG. 1E, and FIG. 1F). Oil cooling can be done with a fan and belt radiator or a heat exchanger that will cross exchange the hot oil with either a cold gas or liquid to cool oil stream 1456 to a desired temperature. After cooling to a desired temperature, oil stream 1556 will flow into an oil storage tank. Cooling the oil from heater treater 1346 will stabilize the crude oil and stop any gas from separating from oil stream 1556 when it enters a low pressure oil storage tank.

The inventors have demonstrated that oil stabilization process 10 enhances the volumetric flow rate of stabilized oil stream 152*b*. It is surmised that low pressure gas stream 154 from the heater treater flowing upwardly in stabilizer tower 40 in close contact with the oil emulsion dissolves or entrains gaseous hydrocarbons in the liquid stream, even while partial fractionation or distillation of the oil occurs in stabilizer tower 40 at typical stabilizer process conditions (temperature and pressure) while retaining pentane and other higher hydrocarbons (such as C5+). Accordingly, it is believed that that fuel heating value of stabilized oil stream 152*a* is not unduly adversely affected.

In this regard, the following process flow data has been calculated, based on a typical live crude oil stream 122, to compare a prior art stabilization system to the stabilization method of system 10.

TABLE 2

| | Wellhead Output | Prior Art Output | System 10 Output | Change |
|---|---|---|---|---|
| Oil BOPD | 6703 | 6,566 | 6,684 | +1.8% |
| Oil Output Loss BOPD | 0 | −137 | −19 | 118 |
| RVP PSIG | | 10 | 8 | 25% |
| Gas MMscfd | 17.89 | 18.29 | 18.17 | −0.70% |
| Water BWPD | 14,510 | 14,510 | 14,510 | — |

The prior art stabilization system in the second data column above is based on a conventional stabilizer model employing a first stage separator operating at 150 PSIG (10.3 bars), a heater treater operating at 50 PSIG and 120 degrees F., and a vapor recovery tower operating at 5 PSIG (0.4 bar). The data for stabilizer system 10 Output in the third data column above is based on a first stage separator 30 operating at 150 PSIG (10.3 bars), a stabilizer tower 40 operating at 6 PSIG, and a heater treater operating at 6 PSIG (0.41 bars) and 140 degrees F. The higher output temperature of gas stream 154 from the heater treater 50 flowing into stabilizer 40 is believed to enhance the conditioning process.

In this regard, the inventors understood that recirculation systems 80 and 280, including gas streams 154 and 354 of system 10 and system 210, enhances the stabilization process by (among other things) increasing the temperature in stabilizer tower 40 or 240 by introducing gas stream 154 or 354 from heater treater 50 or 250. The inventors surmise that the increased temperature within tower 40 improves separation and retention of higher hydrocarbons (such as C5+) into the oil stream.

The first row of Table 2 provides the oil output of the conventional stabilizer system and oil output of system 10 described herein-showing an improvement of in oil output per day of system 10 relative to the conventional stabilizer system. The second row of Table 2 provides the volumetric loss of oil from the available oil in the live crude from the first row. As shown, system 10 yields 118 more barrels per day than the conventional stabilizer system, which is an improvement of approximately 1.8%. The units of Table 2 are million standard cubic feet of gas, barrels of oil per day, and barrels of water per day.

The fourth row of Table 2 provides the gas output of the conventional stabilizer system and the gas output of system 10—showing a decrease or "shrink" in gas production. In this regard, Table 2 reflects an increase in the volumetric flow rate of oil (that is, oil swell or uplift measured by stabilized oil stream 152*a*) that is greater benefit than decrease in volumetric flow rate of the gas (that is, the sum of separator gas output stream 134 and VRU gas output stream 164*a*). Further, because of typical pricing structures in the oil and gas industry, a unit increase in stabilized oil production would outweigh a decrease in gas production of the same percentage magnitude. Thus, even if the magnitude of the percentage changes were equal, system 10 would enhance the stabilization process compared with the conventional system.

The third row of Table 2 provides the Reid Vapor Pressure (RVP) of the oil output. RVP is a property of the fuel at standard conditions-absolute vapor pressure exerted by the vapor of a liquid and any dissolved gases at 100 degrees F., according to test method ASTM-D323. Thus, RVP is a measure of the inherent volatility of the stabilized oil stream 152*a* and correlates to losses of the gas output to the atmosphere. As reported in Table 2, RVP of the gas output from the conventional stabilizing system is reduced from 10 PSIG (0.7 bars to 8 PSIG (0.55 bars) by employing stabilizer system 10.

Fugitive emissions include leaks and other irregular releases of vapors or gasses from a pressurized processes, equipment, valves and piping, and the like. It is believed that the magnitude of fugitive emissions of hydrocarbons is related to pressure. Accordingly, the decrease in RVP, reflecting a decrease in actual pressure, of system 10 compared with that of the prior art (illustrated in Table 2) corresponds and illustrates a decrease in fugitive emissions of conditioning system 10.

The systems and processes described herein refer to process flows from and to components, and/or that a component receives or is adapted to receive a process flow from another component. In this regard, these process flow terms encompass flow directly from the first specified component to the second specified component without major process equipment in between, but including piping, valves, pressure relief devices, safety and monitoring devices, instrumentation, and the like as needed. The description is not limited by prohibiting major process equipment or processes between the first specified component to the second specified component, as it is understood that components, sub-systems, and processes may be added between any of the components (such as wellhead 20 or 220*a-c*, separator 30 or 230, stabilizer tower 40 or 240, heater treater 50 or 250, VRU 60 or 260, and tank 70 or 270), and that the components can be modified in many ways, consistent with the broad conception of the invention and defined in the claims.

The process data provided herein is design data; actual operating data may vary according to change in condition and/or desired output and the like, as will be understood by persons familiar with oil and gas processing technology. Further, the process data provided in the specification is or are examples which are not intended to limit the scope of the invention.

The description herein describes particular examples of components, systems, and processes. The present invention is not limited to the particular components, systems, and processes specified herein. Rather, it is intended that the scope of the present invention be measured by the claims, without viewing any components, systems, or processes of the specification as essential. It is also understood that a person familiar with crude oil stabilization technology would understand that many terms used herein have established meaning that is specific to the oil and gas industry and/or oil stabilization technology, and that the terms inherently include many details that are not necessary to recite.

Further, the information in the Background section describes conventional oil stabilization technology and components. It is not intended to disclaim any subject matter for any component, sub-system, or system, as the preferred embodiments described in the specification incorporate aspects of the conventional technology.

EXAMPLE

The following example is provided to further describe some of the embodiments disclosed herein. The example is intended to illustrate, not to limit, the disclosed embodiments.

FIG. 3C shows an exemplary 3-well production facility but is not limited to the number of wells used in a facility design. Each well head, 220*a*, 220*b*, 220*c* will flow an emulsion fluid, a mixture of oil, gas, and water, to a 3-phase separator 230*a*, 230*b*, 230*c* respectively, for the first stage of processing and separation. The 3-phase separator will separate the inlet emulsion into oil, gas, and water using gravity and retention time. Produced water from each 3-phase separator will comingle and will flow into water storage tanks. Typically a gun barrel 272 is used to catch any oil that is carried over into the water stream. Water from gun barrel 272 is gravity fed into the water storage tank 273. Oil produced in gun barrel 272 is gravity fed into the oil storage tank 270. Water in the water tank 273 is pumped with pump 274 to a salt water disposal facility.

Gas produced in 3-phase separator 230*a*, 230*b*, and 230*c* will comingle gas streams and flow in gas stream 334 to a 2-phase separator 264. This 2-phase separator will capture any liquids and produced condensate from the gas stream. Condensate from 2-phase separator 264 will flow into the produced oil stream 322*a* from the 3-phase separators. Gas leaving 2-phase separator 264 will be sent to sales to be purchased from the midstream purchaser in stream 369*a*. If the midstream purchaser cannot accept the gas or if there is an issue sending gas down sales line, a back pressure valve holding pressure will open and send the gas down stream 369*b* to be combusted using a flare.

A desired amount of gas off stream 369*a* will be sent to a gas compressor 262 that sometimes is used for artificial well head lift. This process involved sending high pressure gas down the tubing of a well head to add pressure downhole to supply force for fluids to rise up the well and enter the 3-phase separator. When gas on the compressor 262 is compressed, condensate is separated from the gas stream and sent down condensate stream 364*a* to comingle with the oil stream 322*a*.

Oil produced from 3-phase separator 230*a*, 230*b*, and 230*c* will be comingled and sent to the maze process through oil stream 322*a*. The maze process used in this example is similar to the process described in FIG. 1C and FIG. 2D. Oil stream 322*a* will enter the stabilizer tower 240 that is equalized in pressure with heater treater 250. There can be a bypass around the stabilizer tower for oil stream 322*a* to enter directly to heater treater 250. Oil flows down the stabilizer tower 240 and gravity feeds into heater treater 250. As oil stabilizes in the stabilizer tower 240, gas is separated from the oil and sent out the top of the tower in gas stream 340*a* to the vapor recovery compressor 260. Vapor recovery compressor 260 typically has an inlet 2-phase separator that will catch any carried over liquids in gas stream 340*a*. This 2-phase separator will typically have a pump of pressurized discharge process for liquids to be transferred. This liquid stream 368*b* will be sent back to the oil stabilizer tower 240.

Gas stream 340*a* will be compressed and sent to a gas cooling process 266 and then to a 2-phase separator 268 to collect condensation from the compression and cooling process. This condensation is sent from 2-phase separator 268 in stream 368*a* to the stabilizer tower to cross exchange with the oil inside the tower. The gas produced from the 2-phase separator 268 will flow in stream 367*a* to comingle with the produced gas stream 334 from the 3-phase separators to be sent to sales. There can be a back pressure valve on stream 367*a* to control the discharge pressure of the vapor recovery compressor 260. Stream 367*b* will be a gas stream that will be sent to the stabilizer tower 240 to maintain a desired gas to oil ratio inside the tower. If the vapor recovery compressor 260 shuts off or cannot handle the flow rate, a back pressure valve will open and send the gas stream 340*b* to a 2-phase separator 295. This 2-phase separator will catch any liquids that are carried over in gas stream 340*b* and send liquids to the oil storage tank 270 using a pump 296. Gas from the 2-phase separator 295 will be sent to flare 291 to be combusted.

Oil from the stabilizer tower 240 is gravity fed into heater treater 250 to be stabilized and process further and get an excess gas and water to be separated from the oil phase. Oil and water pumps are installed to operate a level control process on the heater treater 250. Oil and water will recirculate in the heater treater until a desired height of fluids are reached. When this high water or oil level is reached, the level control process on heater treater 250 will transfer water stream 356 to the gun barrel 272 and oil to the oil cooling process to stabilize the oil further. Once oil stream 352*a* is cooled, oil will be transferred to oil storage tank 270. This oil in stream 352*a* will be stabilized crude and will have zero emissions when it enters and is stored in oil storage tank 270.

Produced gas from the heater treater 250 will free flow into the bottom of the tower in gas stream 280*a* and rise up the stabilizer tower 240 and cross exchange with the oil stream inside the tower. This allows contact point of oil and gas and allows the heavy hydrocarbons to remain in the liquid phase and add extra oil volume and swell to the process. If gas stream 280*a* cannot enter the stabilizer tower 240, a back pressure valve will open up and bypass the tower and send gas stream 280*b* to the vapor recovery compressor 260 or the flare 291 if the vapor recovery compressor is shut off or over ran.

Once oil is sent to be stored in the oil storage tank, a Lease Allocation Custody Transfer unit monitors and controls the oil tank fluid level. Once oil fluid levels reach a desired level in oil storage tank 270, the LACT unit measures and transfers oil down stream 353 to the midstream oil purchaser. All storage tanks including the gun barrel 272, water storage tank 273 and oil storage tank 270 have vent lines comingled that transfer the produced gas to a combustor 292. The combustor can also be a typical flare. A back pressure valve is installed on the vent line out to the flare to keep unnecessary flaring from tank in breathing. Tank in breathing is when storage tanks build up pressure solely from filling up with fluids and decreased with SWD pumps or LACT unit pumps drain the fluids from the storage tanks. To prevent flaring when storage tanks fill up with fluids, the back pressure will be set a desired pressure to accommodate the in breathing of tanks and prevent unnecessary gas from being sent to the flare. A flare knock out vessel 293 will capture any carry over fluids off the storage tank vent lines and send any fluids captured back to the oil storage tank 270 using pump 294.

Those skilled in the art will appreciate that numerous changes and modifications can be made to the preferred embodiments disclosed herein and that such changes and modifications can be made without departing from the spirit of the invention. It is, therefore, intended that the appended claims cover all such equivalent variations as fall within the true spirit and scope of the invention.

What is claimed:

1. A system for conditioning live crude oil, comprising a separator adapted for receiving live crude oil from a wellhead and for producing a separator oil output and a separator gas output;

a stabilizer tower adapted for (i) receiving the separator oil output and receiving a heater treater gas output and (ii) producing a stabilizer tower oil output and a stabilizer tower gas output; and a heater treater adapted for (i) receiving the stabilizer tower oil output and (ii) producing a heater treater oil output and the heater treater gas output; wherein the heater treater gas output has a temperature that is higher than the stabilizer tower gas output and the heater treater oil output is stabilized oil.

2. The system of claim 1, further comprising an oil cooling process adapted to receive the heater treater oil output.

3. The system of claim 1, further comprising a vapor recovery unit (VRU) adapted for (i) receiving the stabilizer tower gas output and (ii) producing a VRU gas output and a VRU oil output, the heater treater being adapted for receiving the VRU oil output.

4. The system of claim 3, further comprising a gas cooling process adapted to receive the VRU gas output.

5. The system of claim 4, further comprising a separator adapted to receive the VRU gas output subjected to the gas cooling process.

6. The system of claim 4, wherein the stabilizer tower is further adapted to receive a condensate from the separator adapted to receive the VRU gas output subjected to the gas cooling process.

7. The system of claim 3, wherein the heater treater is adapted for recirculating a recirculating portion of the heater treater oil output into the heater treater.

8. The system of claim 7, wherein the recirculating portion of the heater treater oil output is combined with the VRU oil output upon or before entering the heater treater.

9. The system of claim 3, wherein the live crude oil includes at least an oil component and a gas component, and wherein the system yields an oil volumetric production rate output that is greater than a volumetric production rate of the oil component of the live crude oil from the wellhead, wherein the volumetric production rates are measured in barrels per day (BPD).

10. The system of claim 9, wherein a finished portion of the oil volumetric production rate output is stabilized oil.

11. The system of claim 10, wherein the oil volumetric production rate of the stabilized oil is measured at a stabilized oil storage tank.

12. The system of claim 1, wherein the stabilizer tower is adapted for producing a stabilizer tower water output, thereby at least partially de-watering separator oil output.

13. The system of claim 1, wherein the heater treater is adapted for producing a heater treater water output, thereby at least partially dewatering the oil in the heater treater.

14. The system of claim 3, wherein the VRU is adapted for providing a conditioned portion of the stabilizer tower gas output from the vapor recovery unit to a user.

15. The system of claim 1, wherein the heater treater oil output is recycled to a heater treater inlet.

16. The system of claim 1, wherein the separator is adapted for producing a separator gas output and the system is adapted for providing the separator gas output to one of user, the stabilizer tower, and the heater treater.

17. The system of claim 1, further comprising a stabilized oil tank adapted for receiving the stabilized oil from the heater treater.

18. A process of increasing swell in an oil conditioning process, comprising the steps of:

a. receiving a live crude oil stream from a wellhead into a separator, the live crude oil stream including at least an oil component and a gas component;

b. separating a first gas stream from the live crude oil in the separator to create at least a first oil stream;

c. receiving the first oil stream from the separator into a stabilizer tower;

d. separating a second gas stream from the first oil stream in the stabilizer tower to create a second oil stream;

e. receiving the second oil stream into a heater treater;

f. separating a third gas stream from the second oil stream in the heater treater to create a stabilized oil stream and a third oil stream, and g. circulating the third gas stream from the heater treater to the stabilizer wherein the third gas stream combines with the second gas stream to create a combined second gas stream, the combined second gas stream flowing to a vapor recovery compressor;

h. moving the stabilized oil stream to a stabilized oil tank; and i. circulating the third oil stream within the heater treater; whereby the stabilized oil stream has a greater volumetric flow rate, measured in (barrels per day) BPD, than the volumetric flow rate of the oil component of the live oil stream, measured in BPD.

19. The process of claim 18, further comprising cooling the stabilized oil stream prior to moving the stabilized oil stream to the stabilized oil tank.

20. The process of claim 18, further comprising cooling the combined second gas stream after said flowing to the vapor recovery compressor.

21. The process of claim 20, further comprising separating a condensate from the cooled combined second gas stream in a second separator.

22. The process of claim 21, further comprising receiving the condensate in the stabilizer tower.

23. The process of claim 18, further comprising the step of circulating a recirculating portion of the second gas stream from the stabilizer tower to the heater treater and a conditioned portion of the second gas stream from the stabilizer tower to a user.

24. The process of claim 18, wherein the step (h) of circulating the third oil stream includes inputting the third oil stream at an inlet of the heater treater.

* * * * *